US011724527B2

(12) United States Patent
Tamura

(10) Patent No.: US 11,724,527 B2
(45) Date of Patent: Aug. 15, 2023

(54) ROLLER, MEDIUM-TRANSPORTING DEVICE, LIQUID EJECTING APPARATUS, AND METHOD OF MANUFACTURING ROLLER

(71) Applicant: SEIKO EPSON CORPORATION, Tokyo (JP)

(72) Inventor: Yosaku Tamura, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 64 days.

(21) Appl. No.: 17/534,682

(22) Filed: Nov. 24, 2021

(65) Prior Publication Data

US 2022/0161576 A1 May 26, 2022

(30) Foreign Application Priority Data

Nov. 26, 2020 (JP) ..... 2020-196412

(51) Int. Cl.

| | |
|---|---|
| ***B41J 11/00*** | (2006.01) |
| ***B41J 13/076*** | (2006.01) |
| ***B41J 2/01*** | (2006.01) |
| ***B65H 29/20*** | (2006.01) |
| ***B65H 5/06*** | (2006.01) |
| ***B41J 11/04*** | (2006.01) |

(52) U.S. Cl.

CPC ..... *B41J 13/076* (2013.01); *B41J 2/01* (2013.01); *B41J 11/0045* (2013.01); *B41J 11/04* (2013.01); *B65H 5/066* (2013.01); *B65H 5/068* (2013.01); *B65H 29/20* (2013.01)

(58) Field of Classification Search

CPC ..... B41J 11/0045; B41J 13/076; B41J 2/01; B65H 29/20; B65H 5/062; B65H 5/066; B65H 5/068

See application file for complete search history.

(56) References Cited

U.S. PATENT DOCUMENTS

2004/0251618 A1* 12/2004 Niizeki ..... B41J 13/076 271/272
2017/0120632 A1 5/2017 Nakahata et al.
2017/0259592 A1* 9/2017 Tamura ..... B41J 13/076

FOREIGN PATENT DOCUMENTS

JP 2017088260 A 5/2017
JP 2017159997 A 9/2017

* cited by examiner

*Primary Examiner* — Christopher E Mahoney
*Assistant Examiner* — Kendrick X Liu
(74) *Attorney, Agent, or Firm* — Chip Law Group

(57) ABSTRACT

A toothed roller includes: a wheel having teeth on a peripheral surface; and holders that hold n wheels, which satisfy condition 1 and condition 2 described below, such that the n wheels are stacked in an axial direction, n being a natural number of 2 or more. Condition 1 is Pr=Pt/n, where Pr is a tooth pitch of the toothed roller and Pt is a tooth pitch of the wheel. Condition 2 is such that a minimum value of sums of angles each formed by a reference tooth and another reference tooth adjacent thereto in a circumferential direction of one to n wheels is greater than 180 degrees, where one of the teeth is a reference tooth, one of the n wheels is a reference wheel, and wheels having reference teeth near to the reference tooth of the reference wheel are second to nth wheels sequentially.

10 Claims, 14 Drawing Sheets

ROLLER, MEDIUM-TRANSPORTING DEVICE, LIQUID EJECTING APPARATUS, AND METHOD OF MANUFACTURING ROLLER

The present application is based on, and claims priority from JP Application Serial Number 2020-196412, filed Nov. 26, 2020, the disclosure of which is hereby incorporated by reference herein in its entirety.

BACKGROUND

1. Technical Field

The present disclosure relates to a roller that transports a medium such as a sheet, a medium-transporting device, a liquid ejecting apparatus, and a method of manufacturing the roller.

2. Related Art

As printing apparatuses such as liquid ejecting apparatuses, ink jet printers that eject liquid such as ink onto a medium such as a sheet transported by a transport roller and perform printing on the medium have been known. Examples thereof include a printer that includes toothed rollers which nip and transport a medium subjected to printing (for example, refer to JP-A-2017-159997). According to JP-A-2017-159997, a plurality of toothed rollers each including a wheel formed of a circular metal sheet having a plurality of tooth tips and a holder that rotatably supports the wheel are provided at an interval in a width direction of a medium, which intersects a transport direction of the medium with respect to a drive shaft, which is an example of a rotational shaft. The transport rollers configured as described above transport the medium by using tooth tips of wheels that come into contact with the medium, and the contact area between the medium and the toothed rollers is thus reduced, thereby suppressing transfer of ink from the medium.

Since the wheel constituting the toothed roller of JP-A-2017-159997 is constituted by the metal sheet formed by press working, the metal sheet is formed by cutting off tie-bar sections that couple a base material and the metal sheet to each other. Thus, tie-bar cut sections are formed, in addition to the tooth tips, on the outer periphery of the wheel formed of the metal sheet. The tie-bar cut sections differ from the tooth tips in shape and are formed on a radial inner side of the wheel with respect to the tooth tips. Thus, when the number of teeth of the metal sheet increases, no tooth is provided in portions in which the tie-bar cut sections are formed, and an imaginary circle provided by joining the tooth tips of the wheel into an annular shape is an imperfect circle. In an instance in which tie-bar cut sections of wheels adjacent to each other in an axial direction (medium-width direction) overlap or are distributed unevenly in a circumferential direction of the toothed roller when the toothed roller is viewed in the axial direction, the shape of the toothed roller is an imperfect circle. As a result, transport accuracy of the medium transported by the toothed roller may be reduced.

Accordingly, in JP-A-2017-159997, a plurality of wheels are shifted in the circumferential direction when fit into each other in a state of being stacked in the axial direction via holders, which are members separate from the wheels, and the tie-bar cut sections are thus prevented from being distributed unevenly in the circumferential direction when viewed in the axial direction.

However, in the toothed roller of JP-A-2017-159997, the tie-bar cut sections are not distributed unevenly in the circumferential direction when viewed in the axial direction, but when portions that are thick due to a variation in thickness of the holders in the circumferential direction are stacked, a difference in thickness between the thick portions and other portions in the circumferential direction accumulates. In such an instance, the thickness of the toothed roller in the circumferential direction varies largely. Accordingly, when assembled on the drive shaft, which is an example of the rotational shaft, the toothed roller is inclined in the axial direction, thus posing a problem of skewing that causes the medium transported by the toothed roller to be skewed being likely to occur.

Note that a toothed roller as in JP-A-2017-159997 causes such a problem, and, for example, a roller in which holders holding wheels are stacked in the axial direction causes a similar problem even when the wheels are formed not by press working but by another working method of etching or the like and include no tie-bar cut section.

SUMMARY

To address the aforementioned problem, a roller that transports a medium includes: a wheel having a plurality of teeth on a peripheral surface; and holders that hold n wheels, which satisfy condition 1 and condition 2, such that the n wheels are stacked in an axial direction, n being a natural number of 2 or more, condition 1: Pr=Pt/n, where Pr is a tooth pitch of the roller, and Pt is a tooth pitch of the wheel, and condition 2: a minimum value of sums of angles each formed by a reference tooth and another reference tooth adjacent to the reference tooth in a circumferential direction of one to n wheels is greater than 180 degrees, where one of the plurality of teeth is a reference tooth, and one of the n wheels is a reference wheel, a wheel having a reference tooth nearest to the reference tooth of the reference wheel in the circumferential direction when viewed in a rotational axis direction of the wheel is a second wheel, and wheels having reference teeth near to the reference tooth of the reference wheel in a direction identical to a direction in which the reference tooth of the second wheel is positioned with respect to the reference tooth of the reference wheel are second to nth wheels sequentially.

To address the aforementioned problem, a medium-transporting device includes: the roller described above; a second roller that holds the medium against the roller; and a drive source that rotates the roller, in which the second roller extends toward one side in the axial direction further than one of the n holding sections, which is positioned furthest on the one side in the axial direction and on the one side of which a wheel is not arranged.

To address the aforementioned problem, a liquid ejecting apparatus includes: a liquid ejecting head that ejects a liquid; and the roller described above, in which the roller transports the medium onto which the liquid is ejected by the liquid ejecting head.

To address the aforementioned problem, a method of manufacturing a roller includes: a preparing step of preparing n wheels, each of which is made of metal and formed to be integrated with a holder made of synthetic resin by outsert molding, n being a natural number of 2 or more; and a stacking step of stacking the n wheels while shifting phases in a circumferential direction, in which the n wheels are stacked in the stacking step so as to satisfy the condition 1 and the condition 2 described above.

DESCRIPTION OF EXEMPLARY EMBODIMENTS

First Embodiment

A first embodiment of a liquid ejecting apparatus will be described below with reference to the drawings. A printing apparatus of the present embodiment is an ink jet printer that forms characters or images on a sheet, which is an example of a medium, by ejecting ink, which is an example of a liquid, onto the sheet.

Figure 1:
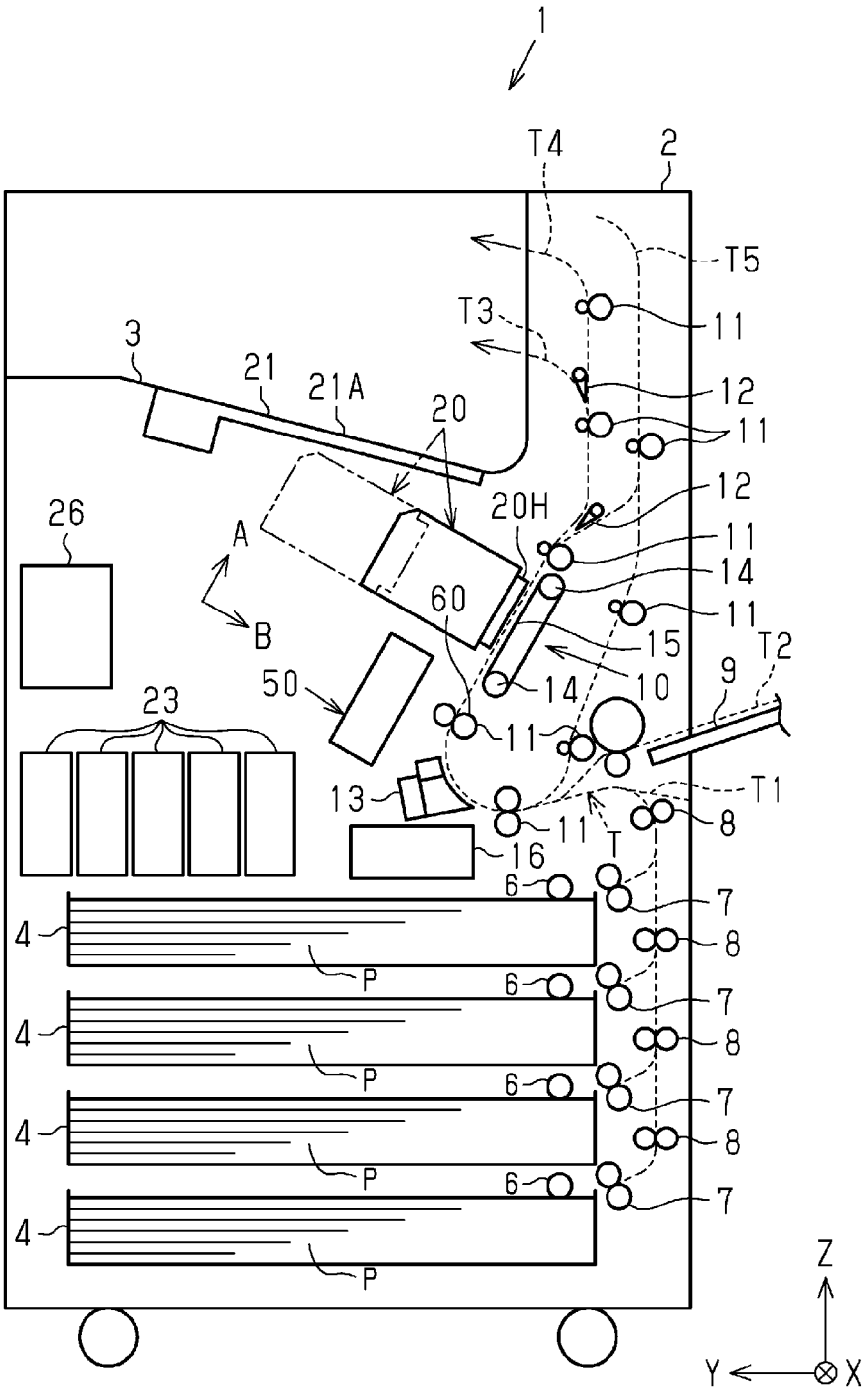
FIG. 1 is a schematic front sectional view illustrating a printing apparatus in a first embodiment.

As illustrated in FIG. 1, a printing apparatus 1, which is an example of the liquid ejecting apparatus, is configured as an ink jet apparatus that performs recording on a medium P such as recording paper by ejecting ink, which is an example of the liquid. Note that the X-Y-Z coordinate system illustrated in each drawing is an orthogonal coordinate system.

The X direction is a width direction of the medium, which intersects a transport direction of the medium, an apparatus depth direction, and, for example, a horizontal direction. The X direction is an example of the apparatus depth direction intersecting both the direction A and the direction B described later. In the X direction, a rearward direction is the +X direction, and a frontward direction is the −X direction.

The Y direction is an apparatus width direction and, for example, a horizontal direction. In the Y direction, a leftward direction and a rightward direction are the +Y direction and the −Y direction, respectively, when viewed from an operator facing the printing apparatus 1. The Z direction is an apparatus height direction and, for example, the vertical direction. In the Z direction, an upward direction is the +Z direction, and a downward direction is the −Z direction.

In the printing apparatus 1, the medium P is transported on a transport path T indicated by the broken line in FIG. 1. The printing apparatus 1 includes a head unit 20, and the head unit 20 includes a liquid ejecting head 20H that ejects liquid. The A-B coordinate system indicated in the Y-Z plane is an orthogonal coordinate system. The direction A is a transport direction of the medium P in a region of the transport path T, which faces the liquid ejecting head 20H. The liquid ejecting head 20H is, for example, a line head capable of ejecting the liquid onto the entire region of the medium P in a width direction X. In the direction A, an upstream direction is the direction −A, and a downstream direction is the direction +A. In this manner, a transport direction of the medium P in the printing apparatus 1 of the present embodiment is a direction inclined so as to intersect both the horizontal direction and the vertical direction.

A movement direction in which the head unit 20 reciprocates with respect to a transport belt device 10 is the direction B. In the direction B, a direction in which the liquid ejecting head 20H approaches the transport path T is the direction +B, and a direction in which the liquid ejecting head 20H is away from the transport path T is the direction −B. The direction B is inclined so as to be orthogonal to the direction A.

The printing apparatus 1 includes a rectangular parallelepiped housing 2. A discharge section 3 to which the recorded medium P is discharged is formed above the center of the housing 2 in the Z direction. Moreover, a plurality of cassettes 4 are detachably attached to the housing 2. The medium P is stored in the plurality of cassettes 4. The medium P stored in the respective cassettes 4 is transported on the transport path T by a pick-up roller 6 and pairs of transport rollers 7 and 8. A transport path T1 on which the medium P is transported from an external apparatus and a transport path T2 on which the medium P is transported from a manual tray 9 provided in the housing 2 merge on the transport path T.

The transport belt device 10, a plurality of pairs of transport rollers 11 for transporting the medium P, a plurality of flaps 12 for switching a path on which the medium P is transported, and a medium-width sensor 13 for detecting a width of the medium P in the X direction are arranged on the transport path T. Of the plurality of pairs of transport rollers 11, a pair of transport rollers 11 positioned upstream of a recording position in the transport direction and closest to the recording position on the transport path T is constituted by toothed rollers. Note that the recording position is a position on the transport path T, which faces the liquid ejecting head 20H. The pair of transport rollers 11 is denoted by reference numeral 60 to be particularly distinguished from the other pairs of transport rollers 11 and is hereafter referred to as a pair of transport rollers 60. The pair of transport rollers 60 includes a drive roller 70, which is an example of a roller, and a driven roller 80.

The transport path T is curved in a region facing the medium-width sensor 13 and extends obliquely upward, that is, in the direction A, from the medium-width sensor 13. A transport path T3 and a transport path T4 leading toward the discharge section 3 and an inverting path T5 on which the front and back of the medium P are inverted are provided downstream of the transport belt device 10 on the transport path T. A discharge tray (not illustrated) for the transport path T4 is provided in the discharge section 3.

The printing apparatus 1 includes a raising/lowering mechanism (not illustrated) that moves the head unit 20 in a raising/lowering direction. Here, the direction B is a direction in which the head unit 20 is displaced. A liquid storage section 23 that stores liquid such as ink, a waste-liquid accumulation section 16 that accumulates waste liquid of ink, and a control section 26 that controls operation of the respective sections of the printing apparatus 1 are provided in the housing 2. The liquid storage section 23 supplies the ink to the liquid ejecting head 20H via a tube (not illustrated). The liquid ejecting head 20H ejects the liquid, such as ink, which is supplied, from nozzles (not illustrated) onto the medium P transported on the transport path T.

As illustrated in FIG. 1, the printing apparatus 1 includes a maintenance device 50 that performs maintenance of the liquid ejecting head 20H. The maintenance device 50 includes a capping unit (not illustrated) having a cap. At maintenance time, the control section 26 causes the head unit 20 to retreat in the direction −B and causes the maintenance device 50 to move from a retreat position illustrated in FIG. 1 to a maintenance position facing the liquid ejecting head 20H to clean the nozzles of the liquid ejecting head 20H.

As illustrated in FIG. 1, the discharge section 3 includes a discharge tray 21 forming the bottom of the discharge section 3. The discharge tray 21 is a member having a plate shape and includes a mounting surface 21A on which the discharged medium P is mounted. Moreover, the discharge tray 21 is provided in the +Z direction with respect to the head unit 20 in the Z direction at a position downstream of the transport belt device 10 on the transport path T of the medium P. Specifically, the discharge tray 21 is arranged in an inclined posture such that a downstream end of the discharge tray 21 is located in the +Z direction with respect to an upstream end thereof. The mounting surface 21A is inclined so as to extend obliquely upward in the discharge direction of the medium P. Note that the respective components of the printing apparatus 1 are simplified in FIG. 1.

The control section 26 controls transport of the medium P in the printing apparatus 1 and operation of the head unit 20 for recording information on the medium P. That is, the control section 26 controls drive sources of the pairs of transport rollers 11 and the transport belt device 10 and controls the liquid ejecting head 20H.

Figure 2:
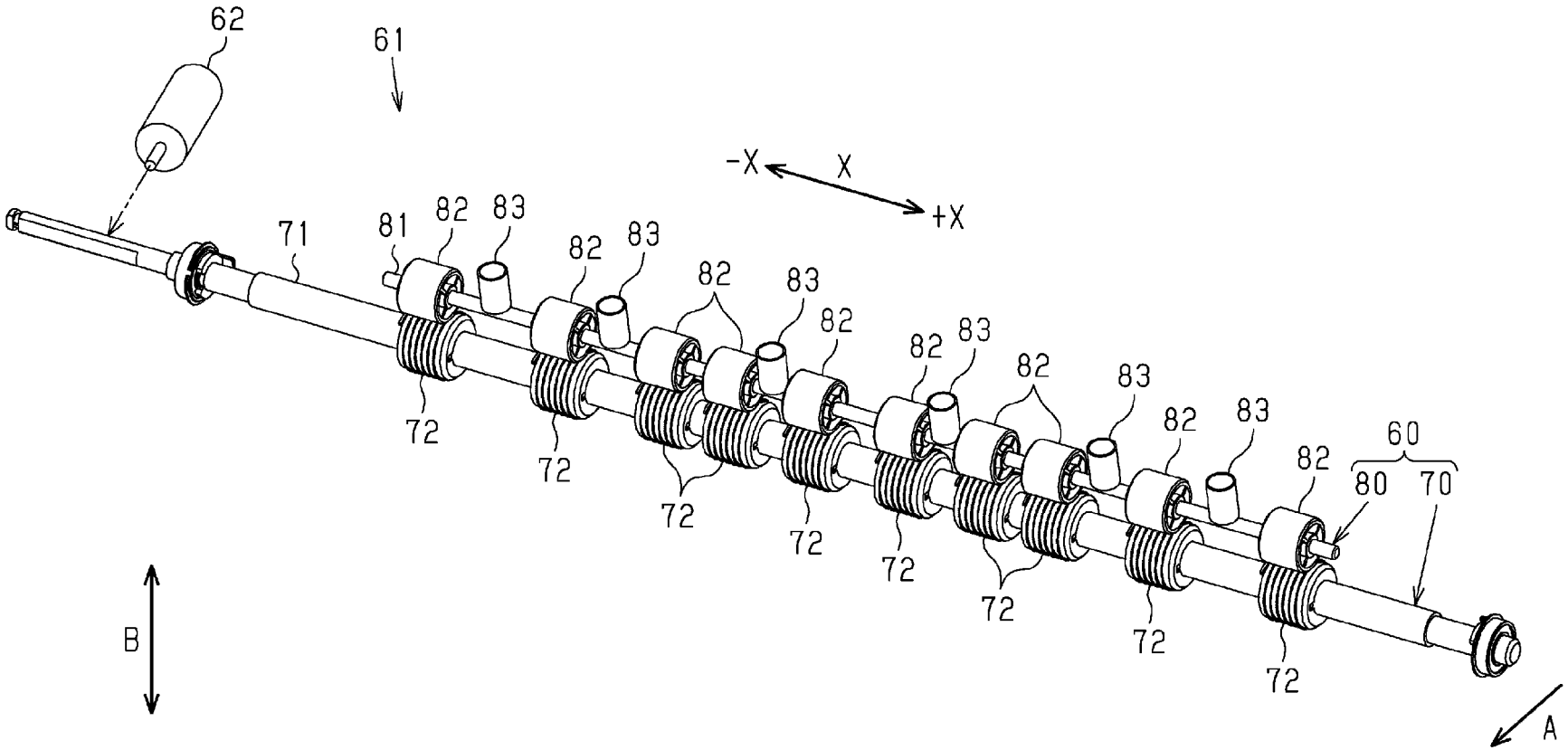
FIG. 2 is a perspective view illustrating a pair of transport rollers.

As illustrated in FIG. 2, the pair of transport rollers 60 includes the drive roller 70, which is an example of the roller, and the driven roller 80 driven to rotate in accordance with rotation of the drive roller 70. The drive roller 70 and the driven roller 80 are arranged side by side in the direction B. The drive roller 70 is rotatable through being driven with power supplied from a drive source 62 such as an electric motor. The driven roller 80 is arranged at a position facing the drive roller 70 with the transport path T (refer to FIG. 1) interposed therebetween. In the present embodiment, a medium-transporting device 61 that transports the medium P to a recording region of the liquid ejecting head 20H is constituted by the pair of transport rollers 60 and the drive source 62. The drive roller 70 transports the medium P, onto which the liquid is ejected by the liquid ejecting head 20H, together with the driven roller 80.

As illustrated in FIG. 2, the drive roller 70 includes a drive shaft 71, which is an example of a rotational shaft, extending in the width direction X and a plurality of toothed rollers 72 inserted into the drive shaft 71. In the example illustrated in FIG. 2, for example, ten toothed rollers 72 are inserted into the drive shaft 71. The respective toothed rollers 72 are fixed to the drive shaft 71 in a state of being arranged at an interval in the width direction X, in which the drive shaft 71 extends, and are provided to be rotatable together with the drive shaft 71.

The driven roller 80 includes a driven shaft 81 extending in the width direction X and a plurality of rollers 82 inserted into the driven shaft 81. In the example illustrated in FIG. 2, for example, the number of rollers 82 is ten, which is the same as the number of toothed rollers 72. The rollers 82 are arranged at positions facing the toothed rollers 72 in the direction B and supported to be rotatable about the driven shaft 81. Each of the rollers 82 is provided such that a peripheral surface thereof is a uniformly circular peripheral surface with no irregularities and is configured to be able to come into surface contact with the transported medium P (refer to FIG. 1) while rotating in accordance with movement of the medium P. The driven roller 80 includes urging members 83, such as coil springs, which extend vertically upward and which are provided on the driven shaft 81 at a plurality of positions (six positions in the present embodiment) different from the positions at which the rollers 82 are arranged. The urging members 83 urge the driven roller 80 against the drive roller 70 by pressing the driven shaft 81 downward.

Figure 3:
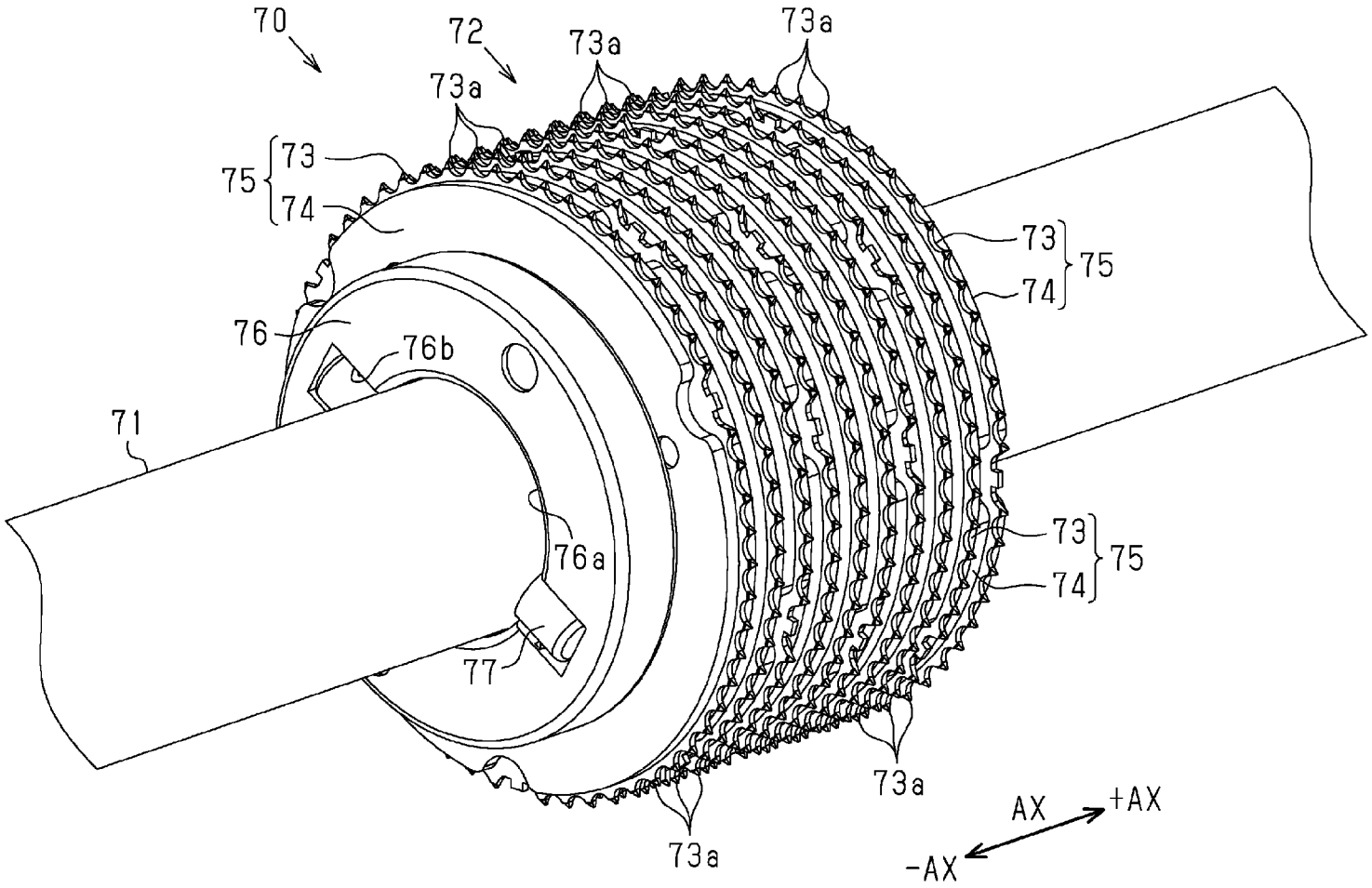
FIG. 3 is a perspective view illustrating a toothed roller constituting a transport drive roller.
Figure 4:
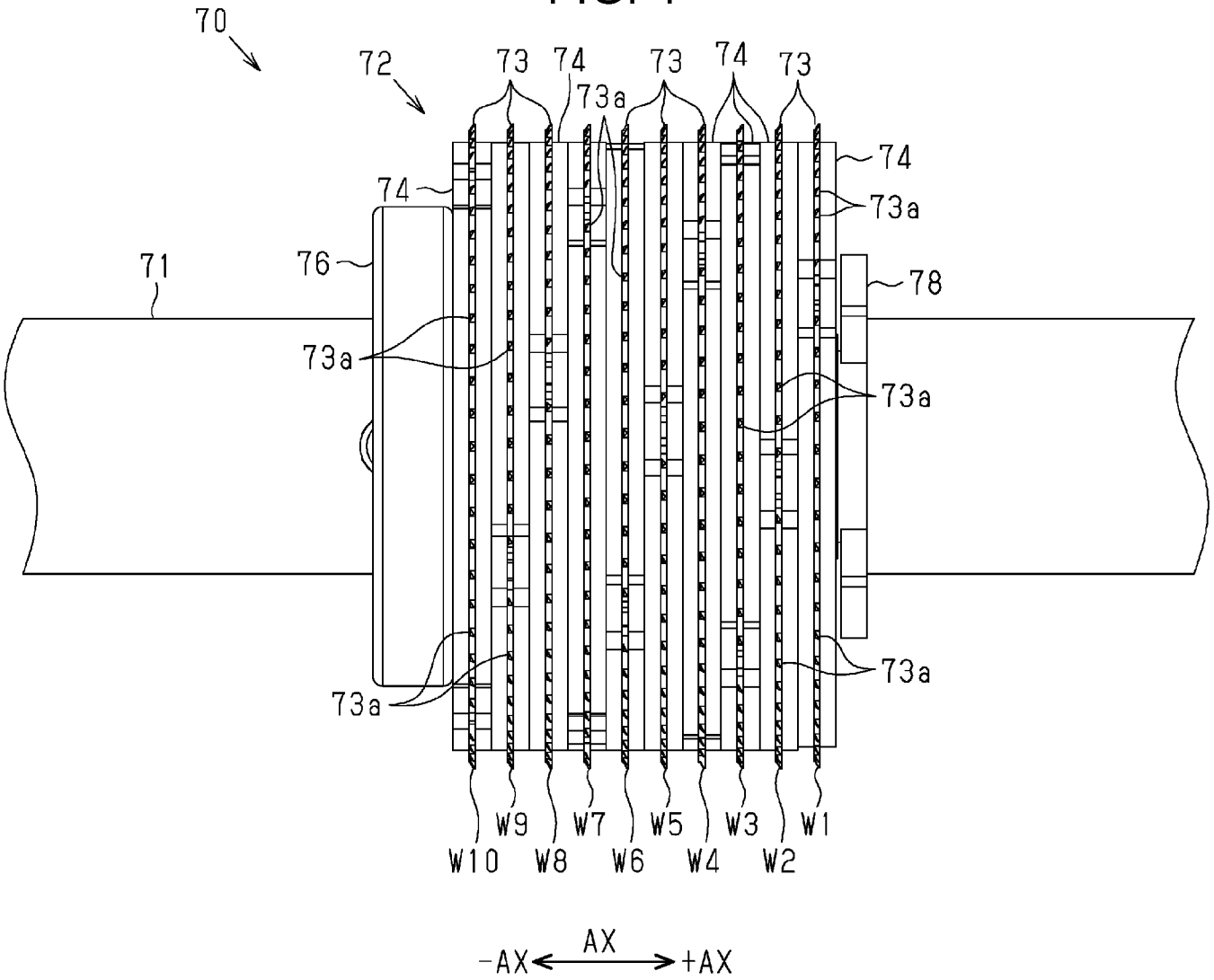
FIG. 4 is a front view illustrating the toothed roller.
Figure 5:
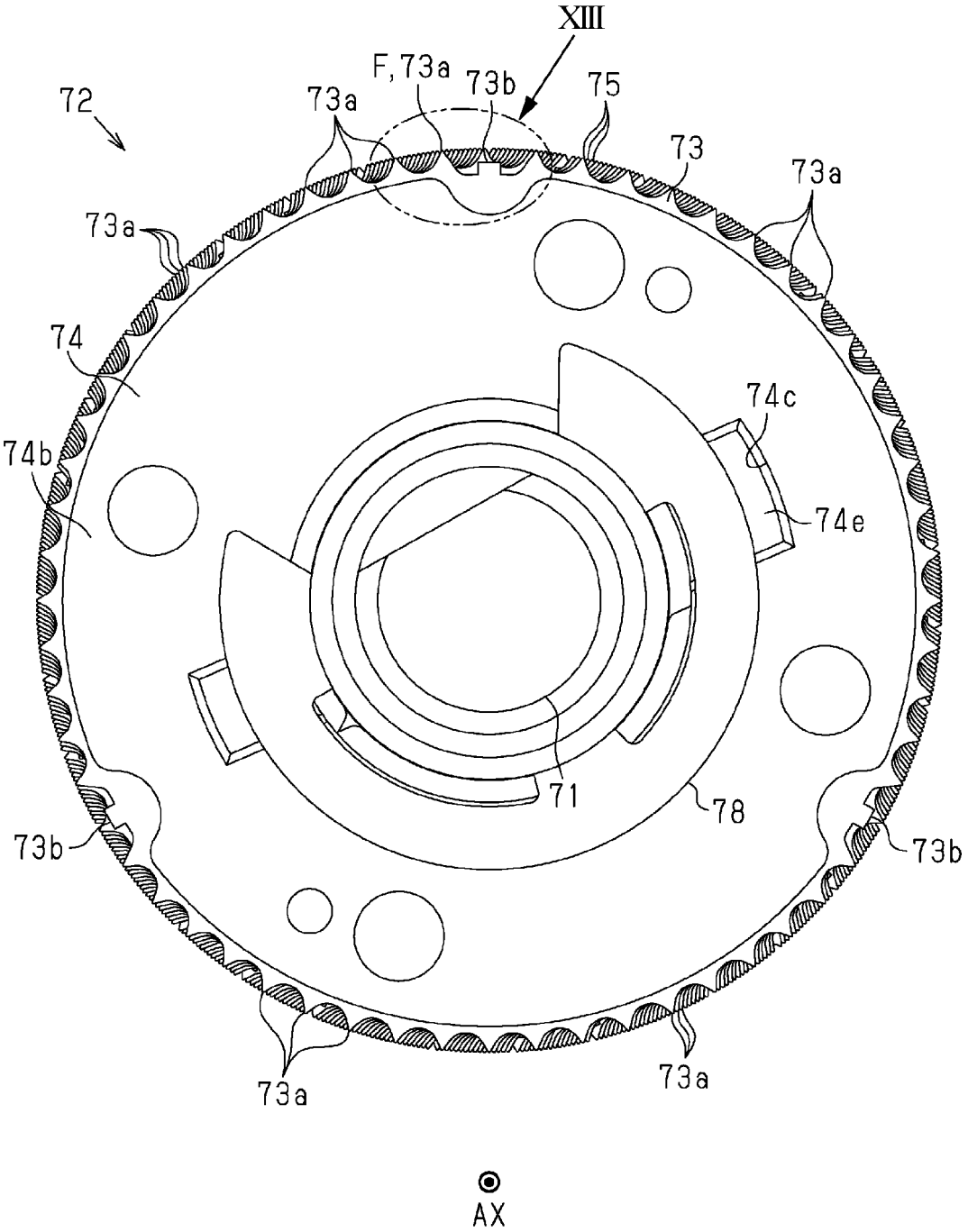
FIG. 5 is side view of the toothed roller viewed in an axial direction.

As illustrated in FIGS. 3 to 5, a toothed roller 72 is formed such that a plurality of wheel members 75, each of which has a ring plate shape and in which wheels 73 (ten wheels 73 in the present embodiment) capable of coming into contact with the medium P (refer to FIG. 1) and holders 74 (ten holders 74 in the present embodiment) holding the wheels 73 are integrally formed, are assembled so as to be stacked in the width direction X. A wheel member 75 is produced by outsert molding of a wheel 73 and a holder 74. The holder 74 has an outer diameter smaller than that of the wheel 73 and a thickness larger than that of the wheel 73. In a state in which an outer peripheral edge of the wheel 73 protrudes radially outward from an outer peripheral end of the holder 74 at a substantially widthwise center of the holder 74 in the thickness direction, a ring-shaped portion of the wheel 73 other than the outer peripheral edge is buried in the holder 74. Teeth 73*a* of the wheel 73 protrude radially outward at a substantially fixed pitch in the circumferential direction in the peripheral edge of the wheel 73, which protrudes radially outward from the outer peripheral end of the holder 74.

Thus, the toothed roller 72 is configured such that the plurality of wheels 73 are held by the plurality of holders 74 in a state in which the wheels 73 are arranged at an interval in the axial direction AX (identical to the width direction X in the present embodiment) orthogonal to the side surfaces of the wheels 73. In the present embodiment, the ten holders 74 other than a holder member 76 which is located in the end on the −AX side in the axial direction AX (identical to the −X side in the width direction X) are formed to be integrated with the respective wheels 73. Each of the holders 74 expands by a given thickness in a substantially ring plate shape from both side surfaces of a corresponding one of the wheels 73 in the axial direction AX.

Thus, the plurality of wheels 73 are held at a given interval (wheel pitch) in the width direction X. A through hole 76*a* into which the drive shaft 71 is inserted and a key groove 76*b* extending in the radial direction intersecting the axis of the through hole 76*a* are formed in the holder member 76 located in the end on the −AX side in the axial direction AX (identical to the −X side in the width direction X). A retaining rod 77 passing through the drive shaft 71 (refer to FIG. 3) in a direction orthogonal to the axial direction of the drive shaft 71 is attached to the holder member 76. A retaining ring 78 is attached to the drive shaft 71 so as to come into contact with the +AX side surface of the holder 74 of the wheel member 75 located in the +AX side end. Thus, the toothed roller 72 is interposed between the retaining rod 77 and the retaining ring 78 in the axial direction (axial direction AX) of the drive shaft 71, thereby restricting movement of the toothed roller 72 in the axial direction AX relative to the drive shaft 71. In addition, the toothed roller 72 is fixed to the drive shaft 71 so as to be rotatable together with the drive shaft 71.

The plurality of wheels 73 (refer to FIG. 6) are formed by performing punching working (press working) for a hoop material (not illustrated) that serves as a base material and is formed of, for example, a stainless-steel sheet. Specifically, a plurality of wheel formed products are formed in the hoop material by punching working (press working). A wheel formed product is supported on the hoop material by three tie-bar sections. In the present embodiment, by performing outsert molding for the hoop material in which the wheel formed products are formed, the holder 74 made of synthetic resin is formed to be integrated with a portion of a wheel formed product other than the outer peripheral edge of the wheel 73. In an outsert molding product, a wheel member formed product (not illustrated) is coupled to the hoop material via the tie-bar sections located at a regular interval, that is, an interval of 120°, in the circumferential direction of the wheel member formed product. The wheel member 75 illustrated in FIGS. 7 to 10 is formed by cutting off the tie-bar sections by using a pressing machine.

Figure 7:
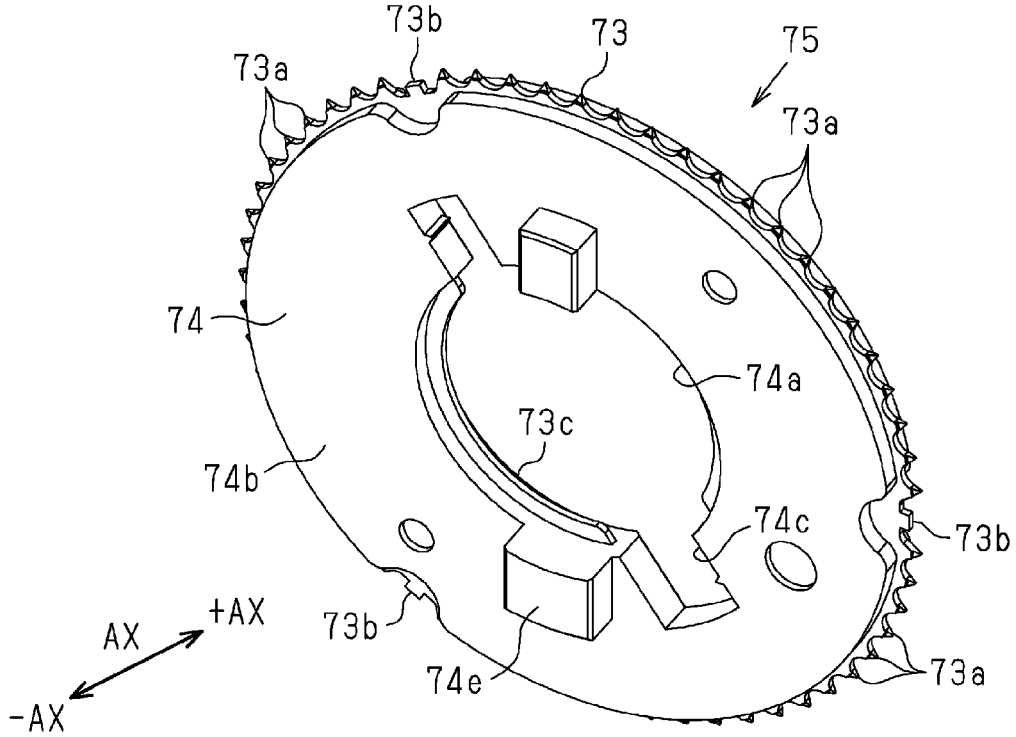
FIG. 7 is a perspective view of a wheel viewed from a first surface side.
Figure 8:
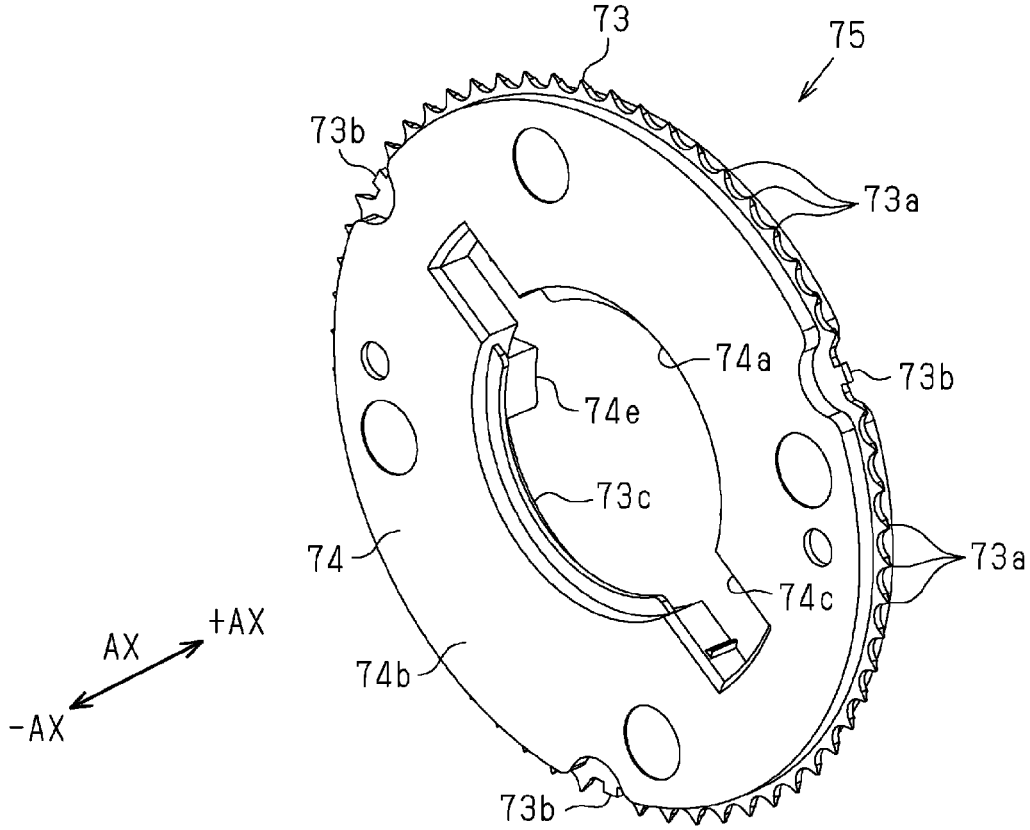
FIG. 8 is a perspective view of the wheel viewed from a second surface side.
Figure 9:
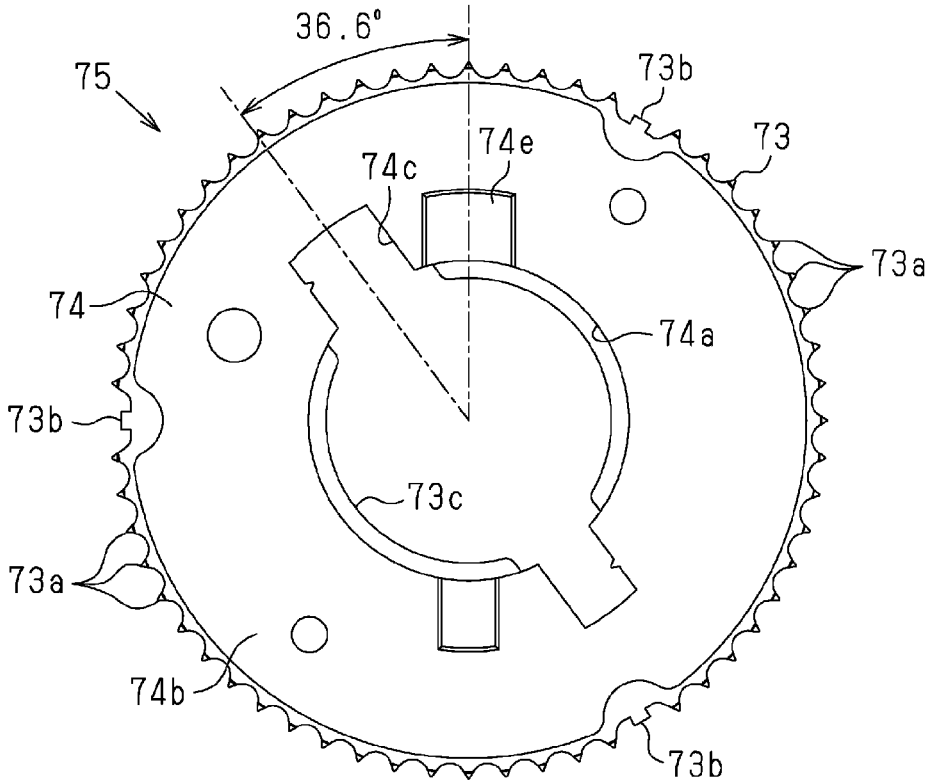
FIG. 9 is a side view illustrating a first surface of the wheel.
Figure 10:
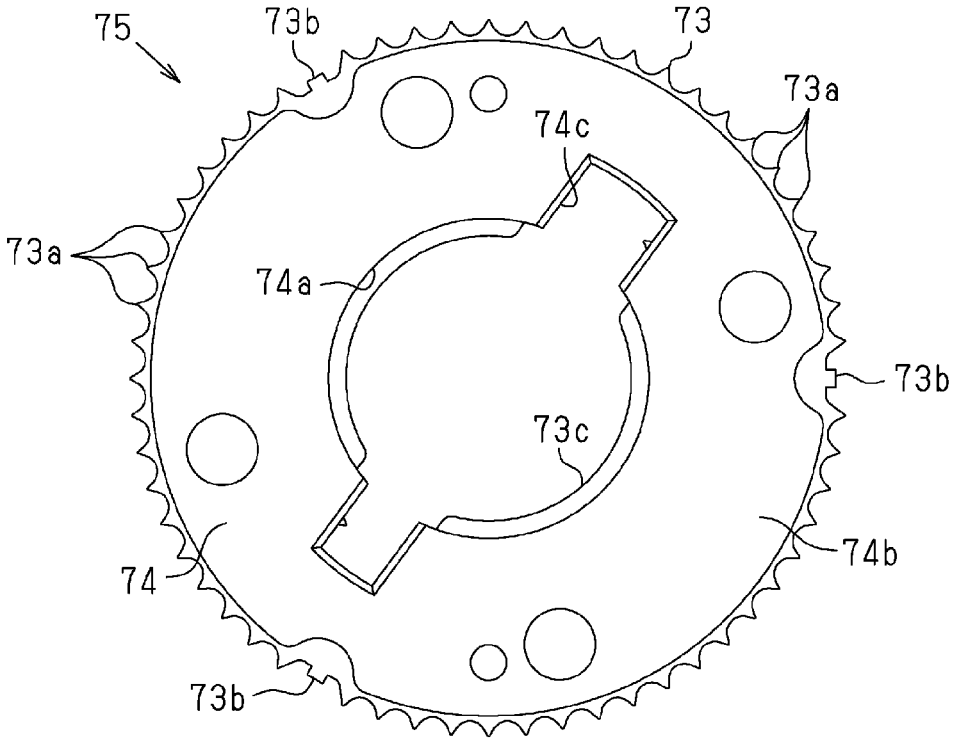
FIG. 10 is a side view illustrating a second surface of the wheel.
Figure 13:
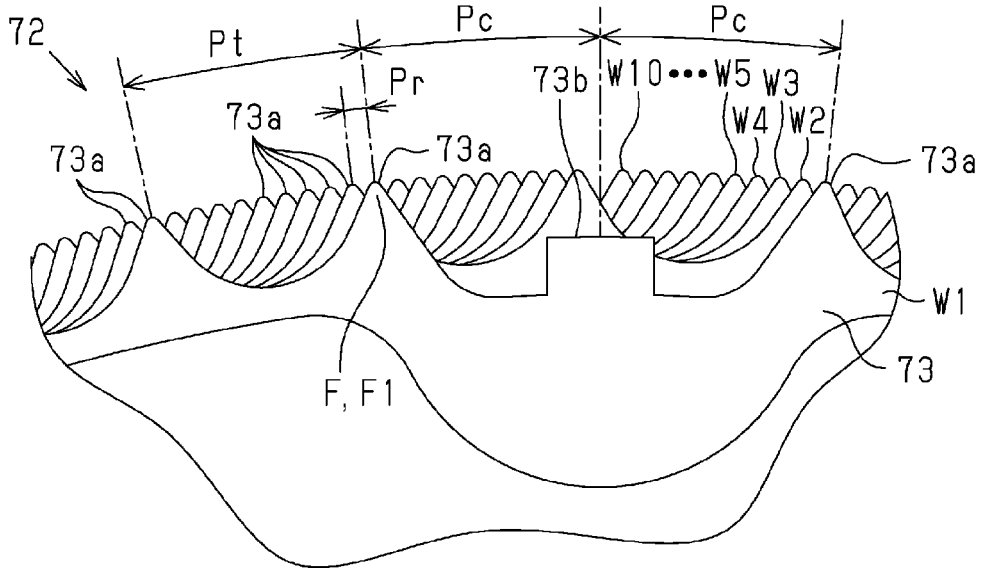
FIG. 13 is an enlarged view of a portion of an outer peripheral edge of wheel members illustrated in FIG. 5.

As illustrated in FIGS. 7 and 8, on the outer periphery of the wheel 73 that constitutes the wheel member 75, the teeth 73*a* protruding radially outward are provided continuously over the entire periphery of the wheel 73. A tie-bar cut section 73*b* that is a cut-off mark of a tie-bar section (not illustrated) is provided on the outer periphery of the wheel 73. Similarly to the tie-bar sections, three tie-bar cut sections 73*b* are provided at a regular interval, that is, an interval of 120°, in the circumferential direction of the wheel 73. As illustrated in FIGS. 9 and 13, a tooth pitch Pt that is a distance between a tooth 73*a* and another tooth 73*a* adjacent thereto in the circumferential direction of the wheel 73 and a pitch Pc that is a distance between a tie-bar cut section 73*b* and a tooth 73*a* adjacent to the tie-bar cut section 73*b* are substantially equal to each other. Accordingly, no tooth 73*a* is formed in portions in which the tie-bar cut sections 73*b* are provided on the outer periphery of the wheel 73. The tip ends of the tie-bar cut sections 73*b* are located on a radial inner side with respect to the tip ends of the teeth 73*a*.

As illustrated in FIGS. 7 to 11, a hole 74*a* passes through the holder 74 in the axial direction AX. On each of a first surface, which is the −AX side surface of the holder 74, and a second surface, which is the +AX side surface of the holder 74, an annular holding section 74*b* having an outer diameter smaller than the outer diameter of the wheel 73 protrudes by a given thickness toward a corresponding one side in the axial direction AX. The hole 74*a* passes through the holding section 74*b*. The holding section 74*b* on the first surface side (−AX side) includes a plurality of engagement holes 74*c* (two engagement holes 74*c* in the present embodiment) that are recessed outward in the radial direction of the holder 74 from an inner peripheral surface of the holding section 74*b*.

Figure 11:
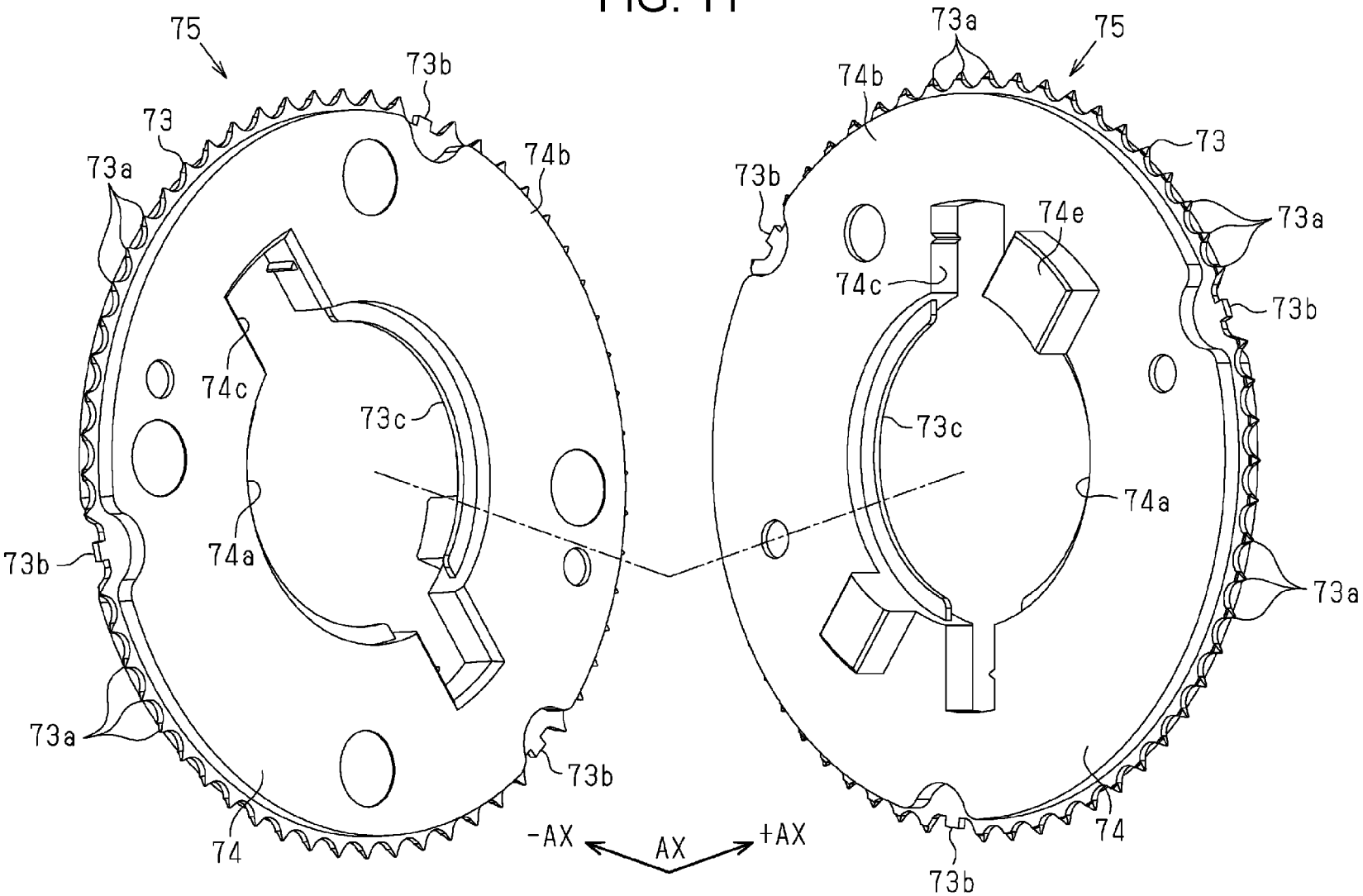
FIG. 11 is a perspective view illustrating two adjacent wheel members.

As illustrated in FIG. 11, the holding section 74*b* on the first surface side (−AX side) of the holder 74 of the wheel member 75 includes a plurality of engagement protrusions 74*e* (two engagement protrusions 74*e* in the present embodiment) that protrude radially outward from positions corresponding to the outer peripheral edge of a hole 74*a* in conformity with engagement holes 74*c* of a holder 74 of another wheel member 75 which is adjacent to the target wheel member 75 in the axial direction AX. The ten holders 74 differ from each other in positions of the engagement holes 74*c* in the circumferential direction and positions of the engagement protrusions 74*e* in the circumferential direction. Note that an engagement piece 73*c*, which corresponds to the inner peripheral edge of the wheel 73, extends along the inner peripheral surface of the hole 74*a* of the wheel member 75. In a state in which the drive shaft 71 is inserted into the hole 74*a* of the wheel member 75, the engagement piece 73*c* engages the outer peripheral surface of the drive shaft 71.

As illustrated in FIG. 11, a holder 74 is assembled with another holder 74 adjacent thereto in the axial direction AX. Specifically, the engagement protrusion 74*e* on the −AX side of the holder 74 of the wheel member 75 on the right side in FIG. 11 is fit into the engagement hole 74*c* on the +AX side of the holder 74 of the wheel member 75 adjacent to the target wheel member 75. Thus, the wheel 73 is interposed between the holders 74 adjacent to each other in the axial direction AX.

The toothed roller 72 in which the plurality of wheel members 75 are stacked in the axial direction AX as described above transports the medium P such that the tip ends of the teeth 73*a* provided on the peripheral surface of the toothed roller 72 come into contact with the medium P. That is, the teeth 73*a* of the toothed roller 72 function as projections capable of coming into point contact with the medium P.

As illustrated in FIG. 13, the teeth 73*a* of the toothed roller 72 are provided in a state of being positionally shifted from each other such that the teeth 73*a* do not completely overlap each other on the peripheral surface of the toothed roller 72 when the toothed roller 72 is viewed in the axial direction AX. That is, the teeth 73*a* are arranged on the peripheral surface of the toothed roller 72 such that all of these are visible when the toothed roller 72 is viewed in the axial direction AX. In the present embodiment, the teeth 73*a* of the toothed roller 72 are arranged at a regular interval in the circumferential direction when the toothed roller 72 is viewed in the axial direction AX. That is, in such a manner that the tooth pitch Pt, which is a distance between a tooth 73*a* and another tooth 73*a* adjacent thereto in the circumferential direction of a wheel 73, is equally divided into n, teeth 73*a* of the other (n−1) number of wheels 73 are arranged, n being the number of wheels 73.

In the present embodiment, since n wheel members 75 are stacked in the axial direction AX such that a position at which adjacent wheel members 75 are assembled is shifted in the rotational direction, a pitch of the teeth 73*a* in the circumferential direction of the wheel members 75 is able to be reduced to 1/n the pitch Pt of the teeth 73*a* in the circumferential direction of the wheel 73. Accordingly, the drive roller 70 having the toothed roller 72, which is manufactured by performing press working, which provides high cost performance and also has high productivity, is able to exert a function similar to that of a drive roller manufactured by performing etching working, which has high working costs and low productivity. However, due to a limitation of the current press working, a gap between tooth tips needs to be about 1 mm. Thus, for example, a roller outer diameter needs to be about 33 mm to provide a tooth pitch of 3.6°. Since a conventional roller outer diameter is about 20 mm, an increase in the roller outer diameter increases the product size of the printing apparatus 1.

Thus, the number of stacked wheels 73 is increased to achieve a tooth pitch Pr=0.6° per roller while keeping the roller outer diameter of about 20 mm. Since a wheel 73 having an outer diameter of 20 mm provides a tooth pitch Pt=6°, when ten (n=10) wheels 73 are stacked per roller, the tooth pitch Pr per roller is 0.6° (refer to FIG. 13).

Here, when the number of stacked wheels 73 increases, the thickness of the toothed roller 72 in the axial direction AX increases, and a variation in thickness per wheel 73 accumulates. In this instance, a thickness difference (variation in thickness) of the toothed roller 72 in the circumferential direction increases. When the thickness difference is large, the toothed roller 72 may be assembled on the drive shaft 71 in an inclined manner, resulting in the medium P being damaged, and target transport accuracy is not ensured. Although a stack of wheels 73 is interposed between the retaining rod 77 and the retaining ring 78 to thereby form a single toothed roller 72, inclination of the toothed roller 72 causes an assembly problem.

Thus, in the present embodiment, by forming the holder 74 made of synthetic resin so as to be integrated with the wheel 73 by outsert molding, the holder 74 of the wheel member 75 is formed thin. The thickness of the toothed roller 72 in the axial direction AX is thereby reduced as much as possible while ensuring a necessary distance as a wheel pitch Pw between two wheels 73 adjacent to each other in the axial direction AX. However, when outsert molding is performed, the holder 74 is able to be formed thin, but the thickness tends to increase in the vicinity of the tie-bar cut section 73*b* corresponding to a gate section of the wheel member 75. That is, a variation in thickness of the wheel member 75 in the circumferential direction is caused particularly when the thickness tends to increase in the vicinity of the gate section during resin molding. However, the thickness does not necessarily increase in the vicinity of all the tie-bar cut sections 73*b*, and, for example, a position of a wheel formed product in the hoop material is also affected. That is, it is difficult to specify which of the plurality of tie-bar cut sections 73*b* affects the thickness. When the wheel members 75 are stacked while thick portions thereof are distributed unevenly in the circumferential direction without considering a variation in thickness of the wheel members 75 in the circumferential direction, the thick portions that are distributed unevenly in the toothed roller 72 are thicker than other portions in the toothed roller 72, and the aforementioned problem may be caused. Thus, the toothed roller 72 of the present embodiment is manufactured so as to satisfy the following conditions.

The toothed roller 72 of the present embodiment includes the wheel 73 having a plurality of teeth 73*a* on a peripheral surface and the holders 74 that hold n wheels 73, which satisfy condition 1 and condition 2 described below, such that the n wheels 73 are stacked in the axial direction, n being an integer of 2 or more.

Condition 1

Condition 1 is a condition for achieving the toothed roller 72 having a tooth pitch smaller than the tooth pitch Pt by using the wheels 73 having the tooth pitch Pt. Condition 1 is provided by the following formula:

$$Pr=Pt/n \quad (1),$$

where Pr is a tooth pitch of the toothed roller 72, and Pt is a tooth pitch of the wheel 73.

Condition 2

Condition 2 is a condition for satisfying (a) and (b) described below.

(a) A single tooth 73*a* of the plurality of teeth 73*a* of the wheel 73 is a reference tooth F (refer to FIG. 5), and a single wheel 73 of the plurality of wheels 73 is a reference wheel W1 (refer to FIG. 4).

(b) A wheel 73 having a reference tooth F nearest to a reference tooth F1 of the reference wheel W1 in the circumferential direction when viewed in the axial direction AX (rotational axis direction) of the wheel 73 is a second wheel W2.

(c) Wheels 73 having reference teeth near to the reference tooth F1 of the reference wheel W1 in the direction R (refer to FIG. 12), which is identical to a direction in which the reference tooth of the second wheel is positioned with respect to the reference tooth F1 of the reference wheel W1, are second to nth wheels W2 to Wn sequentially (refer to FIG. 4). In this instance, a minimum value of sums of angles each formed by two reference teeth F adjacent to each other in the circumferential direction of the n reference teeth F1 to Fn of one to n wheels W1 to Wn is greater than 180 degrees.

Here, a sum SUM θ of angles each formed by two reference teeth adjacent to each other in the circumferential direction of the n reference teeth F2 to Fn is obtained by SUM $\theta=\theta(1,2)+\theta(2,3)+\ldots+\theta(n-1,n)+\theta(1,n)$, where $\theta(1,2)$, $\theta(2,3)$, . . . , $\theta(n-1,n)$ are angles formed by respective reference teeth Fk and Fk+1 of the respective wheels Wk and Wk+1, including the first and second wheels, the second and third wheels, and (n−1)th and nth wheels, where k=1, 2, . . . , n, and k+1=1. Condition 2 is provided by the following formula:

$$\min[\mathrm{SUM}\theta]>180° \quad (2),$$

where min[SUMθ] is a minimum value of sums SUMθ.

The minimum value min[SUMθ] of sums SUMθ of angles each formed by two reference teeth adjacent to each other in the circumferential direction of the n reference teeth F2 to Fn may be larger than 360°. That is, the condition provided by the following formula may be adopted:

$$\min[\mathrm{SUM}\theta]>360° \quad (3).$$

Here, when min[SUMθ] is larger than 180°, a thick portion of a wheel 73 is able to be shifted to the opposite position (farthest position) with the center of the wheel 73 therebetween, thus exerting a specific effect for relieving a variation in thickness of the toothed roller 72. On the other hand, when min[SUMθ] is larger than 360°, thick portions of the n wheels 73 are able to be distributed over the entire circumference, and it is thus possible to further relieve a variation in thickness of the toothed roller 72 in the circumferential direction.

Here, since the sum of angles can vary depending on which of the wheels 73 is used as the reference wheel W1, the condition is defined by a minimum value of sums. That is, sums are obtained by changing the wheel 73 used as the reference wheel W1 sequentially, and a wheel 73 with which a sum has a minimum value is defined as the reference wheel W1 in the condition 2. Moreover, the toothed roller 72 may additionally include an n+1th wheel. The respective reference teeth F of two wheels 73 adjacent to each other in the axial direction AX are not required to be two reference teeth adjacent to each other in the circumferential direction. An angle formed by two reference teeth F adjacent to each other in the circumferential direction, that is, a shift amount, is not required to be the same between all the wheels W1 to Wn. Here, the shift amount is indicated by an angle formed by two reference teeth F adjacent to each other in the circumferential direction. The shift amount is indicated by an angle by which, relative to one reference tooth Fk of two reference teeth adjacent to each other in the circumferential direction, the other reference tooth Fk+1 is shifted.

A value of an angle formed by two reference teeth F adjacent to each other in the circumferential direction, that is, the shift amount, may be the same in all the n wheels 73. When all the shift amounts have the same value, a shift amount Tc is provided by the following formula:

$$Tc=N*Pt+M*Pr \quad (4),$$

where Pr=Pt/n, N and M are natural numbers, and M and n are coprime with respect to each other.

When all the shift amounts Tc have the same value, the condition of formula (2) described above is able to be replaced with the following formula by using a sum Tc*n of the shift amounts Tc:

$$n*Tc>180° \quad (5).$$

Moreover, the sum Tc*n of the shift amounts Tc may be larger than 360°. That is, the condition provided by the following formula may be adopted:

$$n*Tc>360° \quad (6).$$

Here, when the sum Tc*n of the shift amounts Tc is larger than 180°, a thick portion of a wheel 73 is able to be shifted to the opposite position (farthest position) with the center of the wheel 73 therebetween, thus exerting a specific effect for relieving a variation in thickness of the toothed roller 72. On the other hand, when the sum Tc*n of the shift amounts Tc is larger than 360°, thick portions of the n wheels 73 are able to be distributed over the entire circumference substantially equally, and it is thus possible to further relieve a variation in thickness of the toothed roller 72 in the circumferential direction.

A value of N applied to formulas (4) and (5) described above may be a value satisfying the condition of the following formula:

$$N*Pt\geq 180°/n \quad (7),$$

where N and n are coprime with respect to each other.

A value of N applied to formulas (4) and (6) described above may be a value satisfying the condition of the following formula:

$$N*Pt\geq 360°/n \quad (8),$$

where N and n are coprime with respect to each other. Thus, even when the toothed roller 72 is formed by stacking the wheels 73 held by the holders 74 in the axial direction AX, a variation in thickness of the toothed roller 72 due to the reference teeth F being distributed unevenly is less likely to accumulate in the axial direction AX.

In the present embodiment, since the tooth pitch Pt of the wheel 73 is 6° (Pt=6°) and the number of wheels 73 constituting the toothed roller 72 is ten (n=10), when the condition of formula (8) described above is adopted, N 6. For example, a minimum value of 6 (N=6) satisfying the condition is adopted as a value of N. Moreover, a multiple of m may be adopted as a value of N, where m is the number of tie-bar cut sections 73*b* formed to be distributed at a regular interval in the circumferential direction of the wheel 73. As illustrated in FIGS. 5 and 9, the number m of tie-bar cut sections 73*b* is three. Since six is also a multiple of m, N=6 is adopted as an example of N satisfying the condition.

In formula (4) described above, M may be, for example, 1. In an instance in which M is 1, the n wheels 73 are able to be stacked in the axial direction AX such that, in a range of the tooth pitch Pt of the reference wheel W1, teeth 73*a* of the other (n−1) number of wheels W2 to Wn are all seen as illustrated in FIG. 13 when the toothed roller 72 is viewed in the axial direction AX. When M=1 is adopted, the shift amount Tc is provided by the following formula:

$$Tc=N*Pt+Pr \quad (9),$$

where N is a multiple of the tooth pitch Pt of the wheel 73. The tooth pitch Pr of the toothed roller 72 is defined by Pt/(number of wheels n). In the present embodiment, the tooth pitch Pt of the wheel 73 is 6°. Moreover, a value of N is 6. Since the number of wheels 73*n* is 10, the tooth pitch Pr of the toothed roller 72 is 0.6°, obtained by 6°/10. Accordingly, the shift amount Tc is 36.6°, obtained by Tc=6*6°+0.6°.

Figure 6:
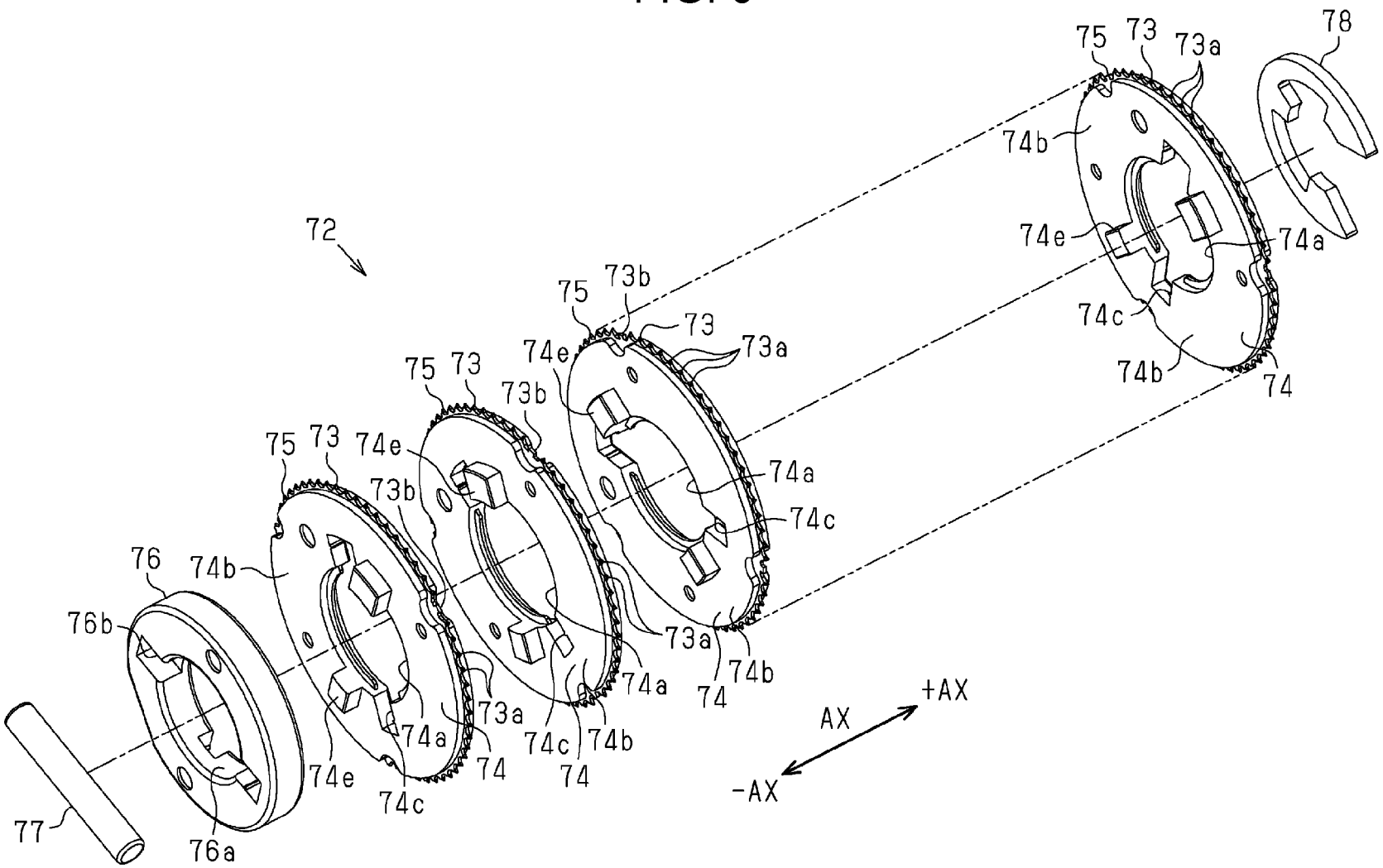
FIG. 6 is an exploded perspective view of the toothed roller including wheels and holders.

In the present embodiment, holders 74 adjacent to each other in the axial direction AX are assembled such that a wheel 73 is shifted from another wheel 73 adjacent thereto in the axial direction AX by the shift amount Tc. Specifically, an engagement hole 74*c* and an engagement protrusion 74*e* are provided in a single holder 74 of the wheel member 75 illustrated in FIG. 9 such that the position of the engagement hole 74*c* formed on the −AX side and the position of the engagement protrusion 74*e* formed on the +AX side differ from each other by the shift amount Tc (=36.6°) in the circumferential direction. Thus, when two wheel members 75 configured as in the wheel member 75 illustrated in FIG. 9 are used and when an engagement protrusion 74*e* is fit into the corresponding engagement hole 74*c* on the surfaces of the wheel members 75, which face each other, as illustrated in FIG. 11, the two wheel members 75 are stacked in a state in which phases are shifted from each other by the shift amount Tc of 36.6°. The n wheel members 75 illustrated in FIG. 6 are sequentially stacked in a state in which phases of the respective wheel members 75 adjacent to each other in the axial direction AX are similarly shifted from each other by the shift amount Tc in the circumferential direction.

Figure 12:
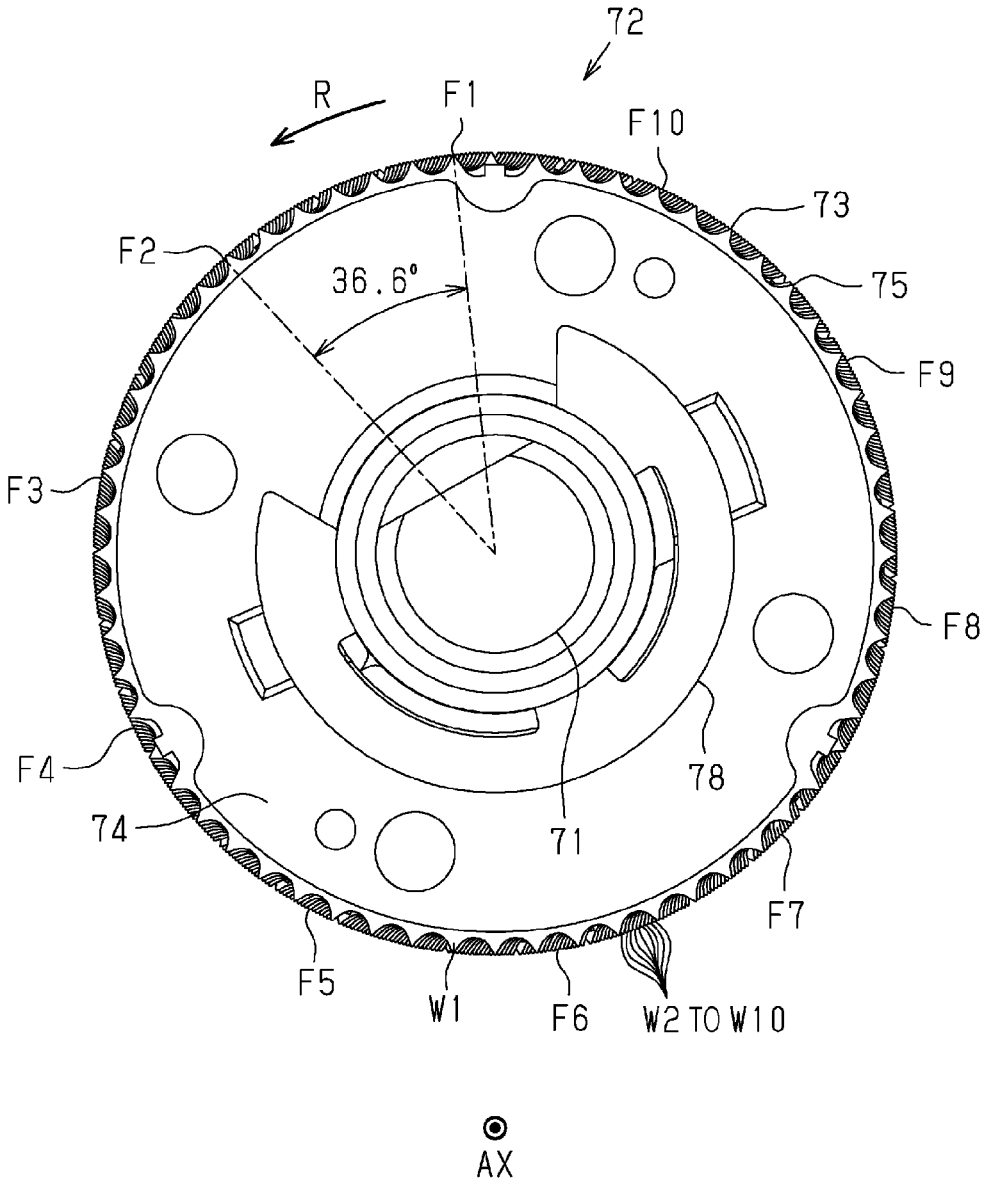
FIG. 12 is a front view of the toothed roller for illustrating positions of reference teeth.

Thus, as illustrated in FIG. 12, ten reference teeth F1 to F10 of the ten wheels 73 are arranged so as to be distributed at a substantially regular interval over the entire circumference when the toothed roller 72 is viewed in the axial direction AX. The ten reference teeth F1 to F10 are arranged in this order in a state in which respective phases are shifted from each other by the shift amount Tc (=36.6°) in the counterclockwise direction R in FIG. 12. Thus, a variation in thickness of the toothed roller 72 in the circumferential direction is relieved.

Figure 14:
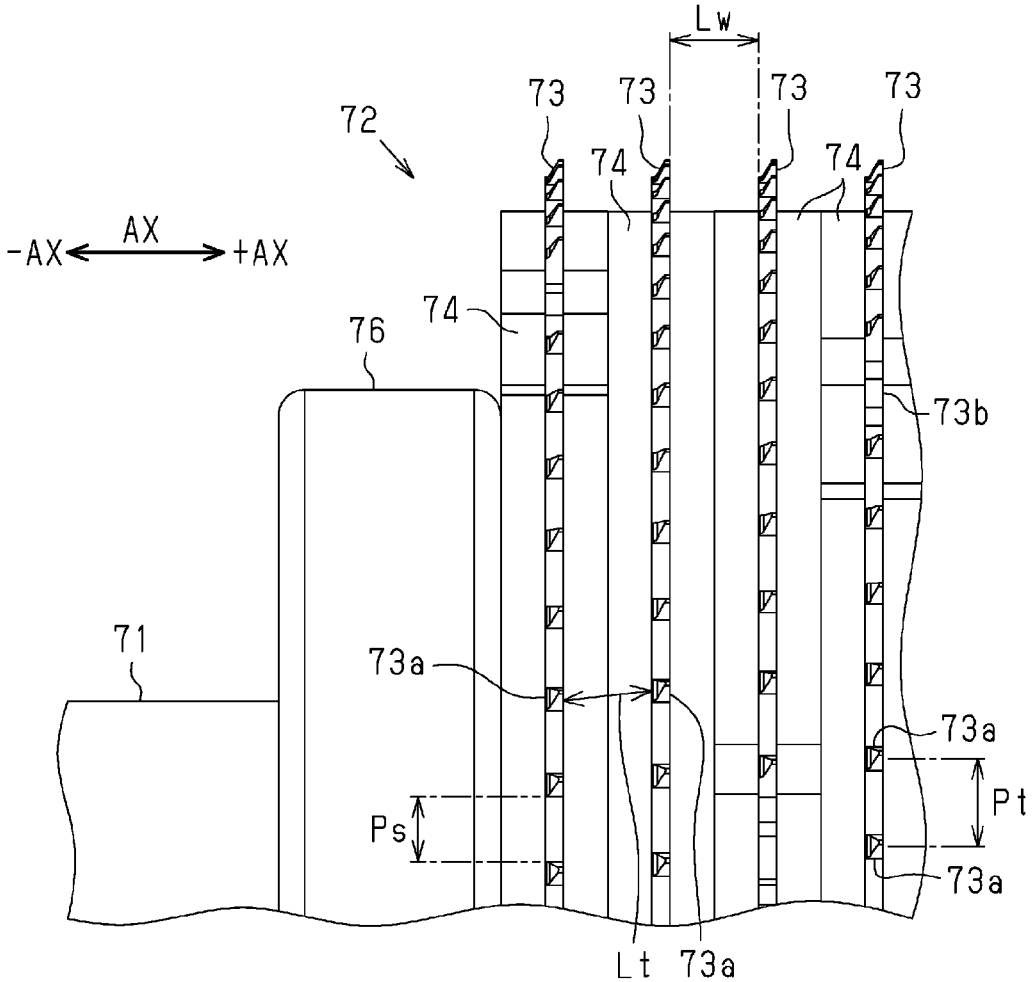
FIG. 14 is a front view of a portion of the toothed roller illustrated in FIG. 4.

Moreover, as illustrated in FIG. 14, in the toothed roller 72 of the present embodiment, a distance Ps between two teeth 73*a* adjacent to each other in the circumferential direction of the wheel 73 may be shorter than a distance Lw between two wheels 73 adjacent to each other in the axial direction AX (Ps<Lw).

Further, as illustrated in FIG. 14, the distance Ps between two teeth 73*a* adjacent to each other in the circumferential direction of the wheel 73 may be shorter than a distance Lt between two closest teeth 73*a* of two wheels 73 adjacent to each other in the axial direction AX.

Moreover, as illustrated in FIGS. 5 and 9, each of the wheels 73 includes a plurality of tie-bar cut sections 73*b*. Angles each formed by two tie-bar cut sections 73*b* adjacent to each other in the circumferential direction of the wheel 73 are all larger than the tooth pitch Pt of the wheel 73.

Further, the holders 74 include n holding sections 74*b* that hold n wheels 73 separately and that are arranged in the axial direction AX.

Figure 15:
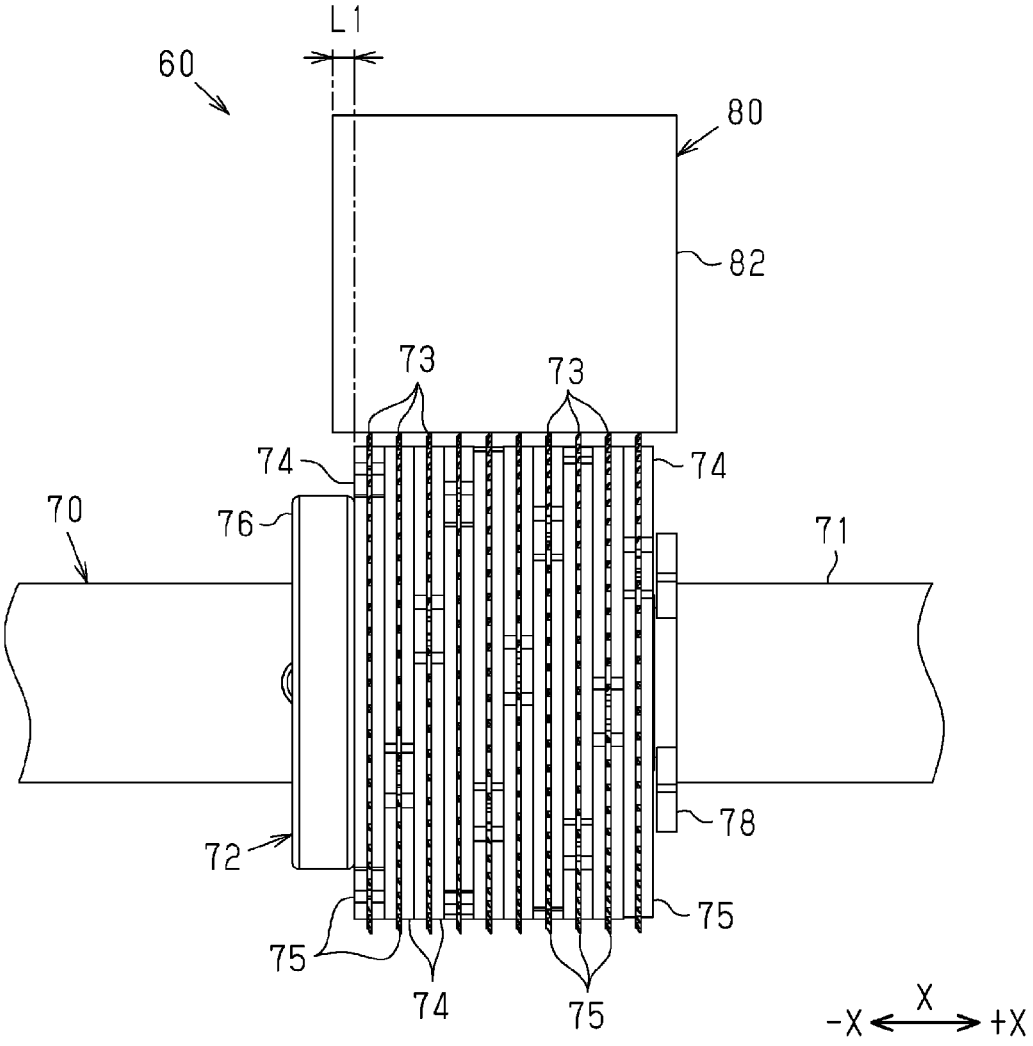
FIG. 15 is a front view illustrating a positional relationship between the toothed roller and a driven roller.

The medium-transporting device 61 includes the drive roller 70, the driven roller 80, which is an example of a second roller, for holding the medium P against the drive roller 70, and the drive source 62 for rotating the drive roller 70. As illustrated in FIG. 15, the driven roller 80, which is an example of the second roller, extends toward one side in the axial direction AX further than a holding section, which is positioned furthest on the one side in the axial direction AX and on the one side of which no wheel 73 is arranged. That is, as illustrated in FIG. 15, the roller 82 of the driven roller 80 is located so as to extend outward in the axial direction AX by a distance L1 from an end surface of the toothed roller 72.

Operation

Operation of the printing apparatus 1 including the pair of transport rollers 60 configured as described above will be described.

When the printing apparatus 1 illustrated in FIG. 1 performs printing on the medium P, the medium P is transported on the transport path T by the plurality of pairs of transport rollers 11, including the pair of transport rollers 60, and the transport belt device 10. When the liquid ejecting head 20H ejects liquid such as ink onto the medium P supported by the transport belt device 10, a character or an image is printed on the medium P. Since recording position accuracy of the liquid ejecting head 20H depends on a transport position of the medium P, the pair of transport rollers 60 that feeds the medium P to a recording region facing the liquid ejecting head 20H is required to have transport position accuracy. Since the pair of transport rollers 60 transports the medium P by using the toothed rollers 72, slippage is less likely to occur between the toothed rollers 72 and the medium P, and the medium P is transported with high transport position accuracy. As a result, the liquid ejecting head 20H is able to perform printing on the medium P with high printing accuracy.

The toothed roller 72 illustrated in FIGS. 2 to 5 and 12 is formed such that the n wheel members 75 are stacked in the axial direction AX while respective phases are shifted from each other by the shift amount Tc, which satisfies condition 1 and condition 2. Thus, the thickness of the toothed roller 72 in the axial direction AX has little variation in the circumferential direction.

Comparative Example 1

Meanwhile, in a toothed roller that is formed by stacking a plurality of wheels with a shift amount of 0, thick portions caused by a variation in thickness of holders during resin molding are stacked at the same phase, and the thick portions of the holders accumulate in the axial direction. Thus, the toothed roller has a variation in thickness in the circumferential direction.

Comparative Example 2

According to the toothed roller described in JP-A-2017-159997, the shift amount Tc is set, but has a value of, for example, 15° or 18°, which satisfies Tc*n<180°. Thus, thick portions formed during holder formation when wheels are stacked in the axial direction while respective phases are shifted from each other by the shift amount Tc (for example, 15°) in the circumferential direction together with the holders are insufficiently distributed in the circumferential direction. Accordingly, the toothed roller has a variation in thickness in the circumferential direction.

The toothed roller of Comparative example 1 or 2 has a variation in thickness in the circumferential direction and thus may be assembled to a drive shaft in an inclined manner. In such an instance, there is a problem of skewing of a medium transported by the toothed roller inclined relative to the drive shaft.

EXAMPLES

On the other hand, the toothed roller 72 of the present embodiment is formed by stacking a plurality of wheel members 75 (n wheel members 75) in the axial direction AX while respective phases of the wheel members 75 are shifted from each other in the circumferential direction. The shift amount Tc by which the respective phases of the wheel members 75 are shifted from each other in the circumferential direction is set to a value that satisfies condition 2 described above and further satisfies Tc*n>180°. In particular, in the present embodiment, the shift amount Tc is set to a value satisfying Tc*n>360°. Thus, thick portions formed in the holders 74 during outsert molding are stacked in the axial direction AX while respective phases of the plurality of wheel members 75 (the n wheel members 75) are shifted from each other by the shift amount Tc in the circumferential direction.

For example, as illustrated in FIG. 12, in the toothed roller 72 manufactured such that the n wheels 73 (W1 to W10) are stacked in the axial direction AX, the reference teeth F1 to F10 of the respective wheels 73 are arranged at positions each shifted in the circumferential direction by the shift amount Tc (=36.6°). That is, the n wheels 73 are stacked in a state in which respective phases are shifted from each other by the shift amount Tc in the circumferential direction. Thus, the thick portions formed in the respective wheels 73 during outsert molding are distributed in the circumferential direction. As a result, the toothed roller 72 of the present embodiment has a suppressed variation in thickness in the circumferential direction.

This prevents the toothed roller 72 from being assembled on the drive shaft 71 in an inclined manner. Accordingly, the medium P transported by the toothed roller 72 is less likely to be skewed. As a result, the medium-transporting device 61 including the pair of transport rollers 60 is able to transport the medium P in the transport direction with high transport position accuracy while suppressing the medium P from being shifted in the width direction X.

Method of Manufacturing Roller

Next, a method of manufacturing the drive roller 70 including the toothed roller 72 of the present embodiment will be described with reference to FIG. 16.

Figure 16:
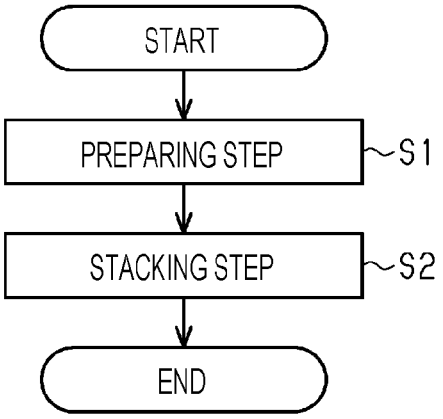
FIG. 16 is a flowchart of a method of manufacturing a roller.

As illustrated in FIG. 16, the method of manufacturing the drive roller 70 includes a wheel preparing step (step S1) and a wheel stacking step (step S2). Note that the wheel preparing step corresponds to an example of a preparing step, and the wheel stacking step corresponds to an example of a stacking step.

In the wheel preparing step (S1), n wheel members 75 (for example, ten wheel members 75) are prepared per roller. Further, n wheels 73 (n wheel members 75) each of which is made of metal and formed to be integrated with a holder 74 made of synthetic resin by outsert molding are prepared, n being a natural number of 2 or more. As the wheel members 75, wheel members manufactured in a plant may be prepared, or wheel members that have been manufactured may be purchased and prepared. In the former case, a plurality of wheel formed products are formed by performing punching working (press working) for a hoop material, and then, in a state in which a peripheral edge including all teeth 73*a* of the wheel 73 is exposed, a ring-shaped portion of the wheel 73 other than the peripheral edge is molded by outsert molding by using a synthetic resin material. The wheel 73 and the holder 74 are thereby formed to be integrated. When tie-bar sections are then cut off by press working, the wheel member 75 separates from the hoop material, thus obtaining a plurality of wheel members 75 (refer to FIGS. 6 to 11). The wheel members 75 each include a plurality of tie-bar cut sections 73*b*.

In the next wheel stacking step (S2), as illustrated in FIG. 6, the single holder member 76 and the ten wheel members 75 are assembled on the drive shaft 71 in a state of being stacked in the axial direction AX. In the present embodiment, as illustrated in FIG. 11, two wheel members 75 adjacent to each other in the axial direction AX are assembled by being the engagement protrusion 74*e* of one of the holders 74 fit into the engagement hole 74*c* of the other holder 74. At this time, positions of an engagement protrusion 74*e* and an engagement hole 74*c* of the holder 74 in the circumferential direction are shifted from each other by 36.6° as illustrated in FIG. 11. Thus, the two holders 74 adjacent to each other in the axial direction AX are assembled in a state of being shifted from each other by 36.6° in the circumferential direction.

In this manner, the holder member 76 and the n wheel members 75 illustrated in FIG. 6 are assembled on the drive shaft 71 while respective phases are shifted from each other by 36.6° in the circumferential direction. A roller assembly that is obtained in a stacked manner as described above is restricted to move in the axial direction AX by the holder member 76 located in the −AX side end and the retaining rod 77 assembled on the drive shaft 71. The retaining ring 78 is assembled on the drive shaft 71 so as to come into contact with an end surface of the holder 74 in the +AX side end, thus retaining a stacking state in the +AX side end of the roller assembly. The remaining nine toothed rollers 72 are assembled on the drive shaft 71 similarly. The drive roller 70 is thus manufactured.

The present embodiment is able to exert the following effects.

(1) The roller 70 (72) that transports the medium P includes the wheel 73 having a plurality of teeth 73*a* on a peripheral surface, and the holders 74 that hold n wheels, which satisfy condition 1 and condition 2 described below, such that the n wheels are stacked in the axial direction AX, n being a natural number of 2 or more. Condition 1 is a condition for satisfying Pr=Pt/n, where Pr is a tooth pitch of the roller 70, and Pt is a tooth pitch of the wheel 73.

Condition 2 is such that a minimum value of sums of angles each formed by a reference tooth F and another reference tooth F adjacent to the reference tooth F in the circumferential direction of one to n wheels W1 to Wn is greater than 180 degrees, where one of the plurality of teeth 73*a* is a reference tooth F, and one of the n wheels 73 is a reference wheel W1, a wheel 73 having a reference tooth F nearest to the reference tooth F of the reference wheel W1 in the circumferential direction when viewed in the axial direction AX of the wheel 73 is a second wheel 73, and wheels 73 having reference teeth F near to the reference tooth F of the reference wheel W1 in a direction identical to a direction in which the reference tooth of the second wheel W2 is positioned with respect to the reference tooth F1 of the reference wheel W1 are second to nth wheels W2 to Wn sequentially. Thus, the reference teeth F are less likely to be distributed unevenly in the circumferential direction, a variation in thickness of the roller 70 is able to be distributed. Moreover, the configuration in which the n wheels 73 are stacked in the axial direction AX is able to achieve the tooth pitch Pr of the roller 70 smaller than the tooth pitch Pt of the wheel 73.

(2) The distance Ps between two teeth 73*a* adjacent to each other in the circumferential direction of the wheel 73 is shorter than the distance Lw between two wheels 73 adjacent to each other in the axial direction AX. Thus, since the distance between the teeth 73*a* of the wheel 73 is short, the number of stacked wheels 73 held by the holders 74 is able to be reduced.

(3) The distance Ps between two teeth 73*a* adjacent to each other in the circumferential direction of a wheel 73 is shorter than the distance Lt between two closest teeth 73*a* of two wheels 73 adjacent to each other in the axial direction AX. Thus, since the roller 70 is able to be reduced in size in the axial direction AX, it is possible to reduce the influence of the reference teeth F being distributed unevenly in the circumferential direction on a variation in thickness of the roller 70 in the circumferential direction. That is, although the reference teeth F being distributed unevenly has a greater influence on a variation in thickness when the roller 70 is thicker in the axial direction AX, the roller 70 is able to be reduced in size in the axial direction AX, and the reference teeth F being distributed unevenly in the circumferential direction of the roller 70 is thus able to have a smaller influence on a variation in thickness of the roller 70.

(4) An angle formed by two reference teeth F adjacent to each other in the circumferential direction is identical across the n wheels 73, and Tc*n, which is the sum of shift amounts Tc, is larger than 360°, where the angle is the shift amount Tc. Thus, since n*Tc>360°, it is possible to further suppress a variation in thickness of the roller 70 in the circumferential direction when the roller 70 is formed by stacking the wheels 73 held by the holders 74 compared with an instance in which n*Tc>180°.

(5) N*Pt >360/n, where N and n are coprime with respect to each other. Thus, even when the roller 70 is formed by stacking the wheels 73 held by the holders 74 in the axial direction AX, a variation in thickness of the roller 70 due to the reference teeth F being distributed unevenly in the circumferential direction of the roller 70 is less likely to accumulate in the axial direction AX.

(6) The wheel 73 includes the plurality of tie-bar cut sections 73*b*, and angles each formed by two tie-bar cut sections 73*b* adjacent to each other in the circumferential direction of the roller 70 are all larger than the tooth pitch Pt of the wheel 73. Thus, since the tie-bar cut sections 73*b* are not distributed unevenly in the circumferential direction of the roller 70, a variation in transporting resistance due to presence/absence of the tie-bar cut sections 73*b* is able to be distributed in the circumferential direction. That is, since the tie-bar cut sections 73*b* having no function of teeth 73*a* for transporting the medium P are distributed in the circumferential direction of the roller 70, a variation in transporting resistance is able to be distributed in the circumferential direction.

(7) The holders 74 include n holding sections 74*b* that individually hold the n wheels 73, a thickness of the holding sections 74*b* in the axial direction AX when the wheels 73 are stacked is larger than a thickness of the wheels 73 in the axial direction AX. Thus, since a gap between respective wheels 73 of the n wheels 73 that are stacked is able to be defined by the thickness of the holding sections 74*b*, the roller 70 has good ease of assembly.

Note that since a gap exists between a tooth 73*a* of a wheel 73 and a tooth 73*a* of another wheel 73 in the axial direction AX and the teeth 73*a* do not adhere each other, liquid such as ink is hard to accumulate in the gap, a deformation such as cockling of the medium P that swells by absorbing liquid is permitted by the gap, or a deformed portion is able to be accommodated in the gap. For example, a roller 70, such as a cylinder roller, which is able to permit a deformation of wrinkles of the medium P that swells with liquid or which is not able to accommodate wrinkles, causes wrinkles of the medium P to be folded over, but it is possible to suppress wrinkles of the medium P from being folded over as described above.

(8) The drive roller 70, the driven roller 80 that holds the medium P against the drive roller 70, and the drive source 62 that rotates the drive roller 70 are included, and the driven roller 80 extends toward one side in the axial direction AX further than one of the n holding sections 74*b*, which is positioned furthest on the one side in the axial direction AX and on the one side of which no wheel 73 is arranged. Thus, the thickness of the holders 74 is able to be reduced accordingly. Even when the wheel 73 is positionally shifted in the axial direction AX, the driven roller 80 readily holds the medium P against the drive roller 70.

(9) The printing apparatus 1, which is an example of a liquid ejecting apparatus, includes the liquid ejecting head 20H that ejects liquid and the drive roller 70. The drive roller 70 transports the medium P onto which the liquid is ejected by the liquid ejecting head 20H. Thus, since the drive roller 70 transports the medium P by using the teeth 73*a* of the wheel 73, the liquid is less likely to be transferred onto the wheel 73 even when the liquid is ejected onto the medium P. For example, the liquid is less likely to be transferred onto the wheel 73 compared with an instance in which the roller 70 in which the wheel 73 has no tooth 73*a* and which transports the medium P by coming into surface contact with the medium P is used.

(10) A manufacturing method includes a preparing step S1 of preparing n wheels 73, each of which is made of metal and formed to be integrated with the holder 74 made of synthetic resin by outsert molding, n being a natural number of 2 or more; and a stacking step S2 of stacking the n wheels 73 while shifting phases in the circumferential direction. The n wheels 73 are stacked in the stacking step S2 so as to satisfy condition 1 and condition 2. Thus, the manufacturing method exerts a similar effect to that of the drive roller 70 (toothed roller 72).

Second Embodiment

A medium-transporting device 61 of a second embodiment will be described with reference to FIGS. 17 and 18. In the present embodiment, in particular, the configuration of the toothed roller 72 of the pair of transport rollers 60 differs from that in the first embodiment. The second embodiment differs from the first embodiment in the shift amount Tc of the wheel member 75.

Figure 17:
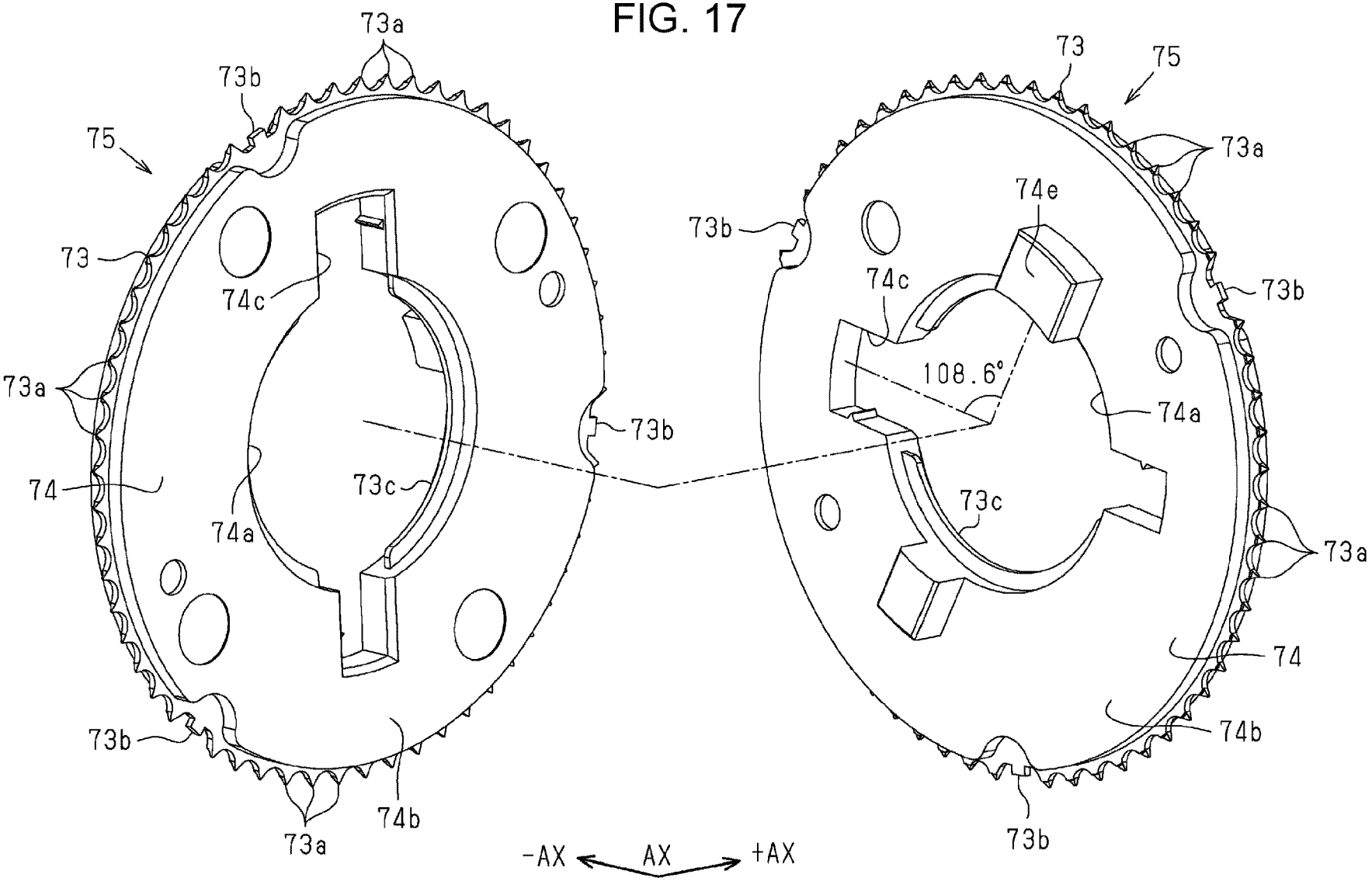
FIG. 17 is a perspective view illustrating two adjacent wheel members in a second embodiment.

As illustrated in FIG. 17, two wheel members 75 adjacent to each other in the axial direction AX are provided such that the position of the engagement hole 74*c* in the circumferential direction differs from the position of the engagement protrusion 74*e* in the circumferential direction by the shift amount Tc (=108.6°). Thus, when the engagement protrusion 74*e* is fit into the engagement hole 74*c* on the surfaces of the two wheel members 75, which face each other, the two wheel members 75 are stacked while respective phases are shifted from each other by the shift amount Tc of 108.6°. The n wheel members 75 are sequentially stacked while respective phases of wheel members 75 adjacent to each other in the axial direction AX are shifted from each other by the shift amount Tc (=108.6°).

Here, regarding the shift amount Tc of the present embodiment, 18 is set as a value of N satisfying the condition of formula (6) described above in the first embodiment. The shift amount Tc=108.6° is adopted when N=18. Other configurations, such as the number of wheels 73 *n* and the number of tie-bar cut sections 73*b*, are similar to those of the first embodiment. According to Tc=N*Pt+Pr represented by formula (9) described above in the first embodiment, the shift amount Tc=108.6° when N=18, Pt=6°, and Pr=0.6°.

Figure 18:
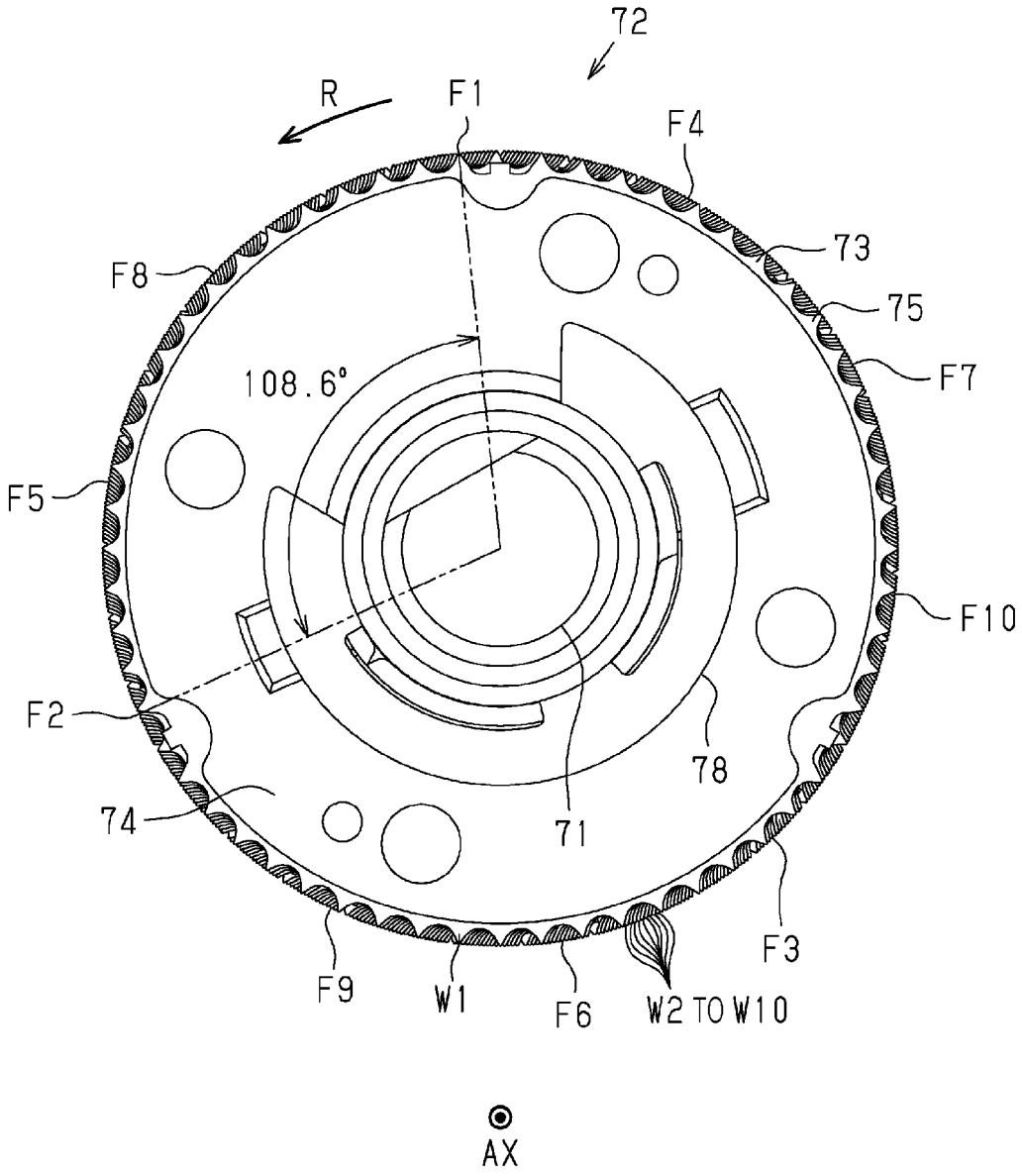
FIG. 18 is a front view of the toothed roller for illustrating positions of reference teeth.

FIG. 18 illustrates an example of arrangement of the reference teeth F1 to Fn of the toothed roller 72 when the shift amount Tc=108.6°. As illustrated in FIG. 18, similarly to those in FIG. 12 in the first embodiment, the reference teeth F1 to Fn are arranged at a substantially regular interval over the entire circumference of the toothed roller 72. However, order in which the reference teeth F2 to Fn subsequent to the reference tooth F1 are arranged in the direction R differs from that in the first embodiment. In the first embodiment, since N satisfying N*Pt*n=3*360° is adopted, the reference teeth F1 to Fn are arranged in this order in the direction R over the entire circumference. On the other hand, in the present embodiment, since a value of N (N=18) satisfying N*Pt*n=360° is adopted, the reference teeth F1 to Fn are arranged over the circumference by making three cycles. Thus, the reference teeth F1 to F4 are arranged in the first cycle, the reference teeth F5, F6, and F7 are arranged in the second cycle at positions between respective reference teeth arranged in the first cycle, that is, a position between the reference teeth F1 and F2, a position between the reference teeth F2 and F3, and a position between F3 and F4, respectively, and the reference teeth F8, F9, and F10 are further arranged in the third cycle at positions between respective reference teeth arranged in the first and second cycles, that is, a position between the reference teeth F1 and F5, a position between the reference teeth F2 and F6, and a position between the reference teeth F3 and F7, respectively. Thus, the present embodiment is substantially the same as the first embodiment in arrangement positions of the n reference teeth F1 to Fn over the circumference, but differs therefrom in arrangement order of the reference teeth F1 to Fn.

Accordingly, also in the toothed roller 72 of the present embodiment, thick portions are not distributed unevenly in the circumferential direction. As a result, an effect similar to the effects (1) to (10) of the first embodiment are obtained.

MODIFIED EXAMPLES

Note that the above-described embodiments may be modified as described in the following modified examples. Further, the above-described embodiments and the modified examples may be combined in any way.

Although the above-described embodiments indicate the example in which N=6 and the example in which N=18, the shift amount Tc may be 72.6° by adopting a value of N (N=12) satisfying N*Pt*n=2*360° with which the reference teeth F1 to Fn are arranged over the circumference by making two cycles. The shift amount Tc may be 144.6° by adopting a value of N (N=24) satisfying N*Pt*n=2*360° with which the reference teeth F1 to Fn are arranged over the circumference by making four cycles. In other words, the shift amount Tc may be set by adopting a value of N (N=12)

satisfying N*Pt*n=J*360° with which the reference teeth F1 to Fn are arranged over the circumference by making J cycles.

The shift amount Tc may be divided into a first shift amount for positioning a tooth 73*a* of the reference wheel W1 and a second shift amount by which a tooth is shifted, in the Pr unit, from the tooth 73*a* that is positioned in accordance with the first shift amount, and the second shift amount=Pr*i may be determined by selecting a random value of i from among 1 to n without allowing duplication.

The shift amount Tc is set in accordance with the condition of Tc*n>360° in the above-described embodiments, but may be set in accordance with the condition of Tc*n>180°. According to such a configuration, a single wheel 73 is able to be shifted by near 180°. That is, a thick portion of a single wheel 73 is able to be shifted to the opposite position with the center of the wheel 73 therebetween. Moreover, since the number of tie-bar cut sections 73*b* which result in thick portions is typically two or more, when the wheel 73 is able to be shifted by about 180°, it is possible to obtain an effect substantially equal or similar to that of the first embodiment, in which the wheel 73 is shifted in a range of about 360°.

As the condition for determining the shift amount Tc, for example, Tc*n>240° or Tc*n>270° may be set, and an angle θc of the right side of the condition may be set to any value in a range of 180°<θc<360°.

In the condition for determining the shift amount Tc, that is, Tc=N*Pt+M*Pr>360°/n or Tc=N*Pt+M*Pr>180°/n, M and n are not limited to being coprime with respect to each other. For example, M may be 3, and n may be 9.

In the above-described embodiments, the numbers and shapes of engagement holes 74*c* and engagement protrusions 74*e* that are fit into each other to stack the wheel members 75 in the axial direction AX may be appropriately changed. Although two engagement holes 74*c* are provided at positions facing two engagement protrusions 74*e* with the center of the wheel 73 interposed therebetween in the above-described embodiments, three engagement holes 74*c* and three engagement protrusions 74*e* or four engagement holes 74*c* and four engagement protrusions 74*e* may be provided in the wheel 73 at different positions in the circumferential direction. Moreover, each of the shapes may be another shape, such as a columnar shape or a triangular prism shape, instead of a rectangular parallelepiped, or the shape may have an engagement claw functioning as a stopper in a state in which the engagement hole 74*c* and the engagement protrusion 74*e* are fit into each other.

In the aforementioned embodiments, the teeth 73*a* of the respective wheels 73 of the toothed roller 72 are not required to be arranged while being shifted so as to be visible on the peripheral surface of the toothed roller 72 when the toothed roller 72 is viewed in the axial direction AX. For example, teeth 73*a* of a given wheel 73 may be arranged so as to completely overlap teeth 73*a* of another wheel 73.

In the above-described embodiments, the number of tie-bar cut sections 73*b* may be set to any number. The number of tie-bar sections is desirably two or more for the wheel formed product to be held by the hoop material with good balance. Thus, the number of tie-bar cut sections 73*b* is desirably two or more and may be, for example, two, four, five, or six.

Any tooth 73*a* is able to be set as the reference teeth F and F1 to Fn in accordance with the definition of condition 2.

Any wheel 73 of the n wheels 73 is able to be set as the reference wheel W1 and the second to nth wheels W2 to Wn in accordance with the definition of condition 2.

In the above-described embodiments, the roller outer diameter may have a value other than 20 mm and may be, for example, 33 mm or another value. The tooth pitch Pt may be a pitch other than 6° and may be, for example, 2°, 4°, 8°, or 10°. Further, the tooth pitch Pr per roller may be a pitch other than 0.6° and may be, for example, 0.4°, 0.8°, or 1°. The number of wheels n may have a value other than 10 and may be, for example, 2, 6, or 15.

In the above-described embodiments, the number of toothed rollers 72 may be set to any number. In other words, the drive roller 70 is required only to include at least one toothed roller 72.

In the above-described embodiments, some of the plurality of toothed rollers 72 of the drive roller 70 may be provided such that a plurality of reference teeth F existing in the circumferential direction of a toothed roller 72 are distributed unevenly when the toothed roller 72 is viewed in the axial direction AX. That is, it is sufficient that at least one toothed roller 72 of the plurality of toothed rollers 72 of the drive roller 70 be provided such that a plurality of reference teeth F existing in the circumferential direction of the toothed roller 72 are not distributed unevenly when the toothed roller 72 is viewed in the axial direction AX.

In the above-described embodiments, the printing apparatus 1 is not limited to being configured to have only a printing function and may be a multi-functional peripheral.

In the above-described embodiments, the liquid ejecting head 20H may be a serial head capable of moving in the width direction X.

In the above-described embodiments, the medium P is not limited to cut paper such as a sheet and may be continuous paper, a resin film, metallic foil, a metal film, a composite film (laminated film) of resin and metal, woven fabric, nonwoven fabric, ceramic sheet, or the like.

In the above-described embodiments, the configuration may be such that, instead of the transport belt device 10 facing the liquid ejecting head 20H, a support table such as a platen for supporting the medium P is provided.

A recording material used for printing may be a fluid other than ink (including a liquid, a liquid body in which particles of a functional material are dispersed or mixed into a liquid, a fluid body such as gel, and a solid that is able to be ejected as a fluid). For example, the configuration may be such that printing is performed by ejecting a liquid body including a material such as an electrode material or a coloring material (pixel material) used for manufacturing a liquid crystal display, an EL (electro-luminescence) display, and a surface-emitting display in a form of dispersion or dissolution.

In addition, the printing apparatus 1 may be a fluid body ejecting apparatus that ejects a fluid body such as a gel (for example, a physical gel) or a particulate matter ejecting apparatus (for example, a toner jet recording apparatus) that ejects a solid exemplified by a powder (particulate matter) such as toner. Further, in this specification, the term "fluid" does not contain a fluid composed of only gas, and examples of a fluid include a liquid (including an inorganic solvent, an organic solvent, a solution, a liquid resin, and a liquid metal (metal melt)), a liquid body, a fluid body, and particulate matter (including grains and powder).

The printing apparatus 1 is not limited to the apparatus that performs printing on a medium such as the medium P by directly ejecting liquid onto the medium and may be an apparatus that performs planographic printing, relief printing, intaglio printing, screen printing, or the like, in which liquid applied to a printing plate is transferred onto a medium.

Hereinafter, technical concepts and effects thereof that are understood from the above-described embodiments and modified examples will be described.

(A) A roller that transports a medium includes: a wheel having a plurality of teeth on a peripheral surface; and holders that hold n wheels, which satisfy condition 1 and condition 2 described below, such that the n wheels are stacked in the axial direction, n being a natural number of 2 or more.

$$Pr=Pt/n, \quad \text{Condition 1}$$

where Pr is a tooth pitch of the roller, and Pt is a tooth pitch of the wheel.

Condition 2

A minimum value of sums of angles each formed by a reference tooth and another reference tooth adjacent to the reference tooth in the circumferential direction of one to n wheels is greater than 180 degrees, where one of the plurality of teeth is a reference tooth, and one the n wheels is a reference wheel, a wheel having a reference tooth nearest to the reference tooth of the reference wheel in the circumferential direction when viewed in a rotational axis direction of the wheel is a second wheel, and wheels having reference teeth near to the reference tooth of the reference wheel in a direction identical to a direction in which the reference tooth of the second wheel is positioned with respect to the reference tooth of the reference wheel are second to nth wheels sequentially.

According to the configuration, since the reference teeth are less likely to be distributed unevenly in the circumferential direction, a variation in thickness of the roller is able to be distributed. The configuration in which the n wheels are stacked in the axial direction is able to achieve the tooth pitch Pr of the roller smaller than the tooth pitch Pt of the wheel.

(B) In the roller, a distance between two teeth adjacent to each other in the circumferential direction of the wheel may be shorter than a distance between two wheels adjacent to each other in the axial direction.

According to the configuration, since a distance between teeth of the wheel is short, the number of stacked wheels held by the holders is able to be reduced.

(C) A distance between two teeth adjacent to each other in the circumferential direction of a wheel may be shorter than a distance between two closest teeth of two wheels adjacent to each other in the axial direction.

According to the configuration, since the roller is able to be reduced in size in the axial direction, it is possible to reduce the influence of the reference teeth being distributed unevenly in the circumferential direction on a variation in thickness of the roller in the circumferential direction. That is, although the reference teeth being distributed unevenly has a greater influence on a variation in thickness when the roller is thicker in the axial direction, the roller is able to be reduced in size in the axial direction, and the reference teeth being distributed unevenly in the circumferential direction of the roller is thus able to have a smaller influence on a variation in thickness of the roller.

(D) An angle formed by two reference teeth adjacent to each other in the circumferential direction may be identical across the n wheels, and Tc*n, which is a sum of shift amounts Tc, may be larger than 360°, the shift amount Tc being the angle.

According to the configuration, since n*Tc>360°, it is possible to further suppress a variation in thickness of the roller in the circumferential direction when the roller is formed by stacking the wheels held by the holders compared with an instance in which n*Tc>180°.

(E) N*Pt≥360/n, where N and n may be coprime with respect to each other.

According to the configuration, even when the roller is formed by stacking the wheels held by the holders in the axial direction, a variation in thickness of the roller due to the reference teeth being distributed unevenly in the circumferential direction of the roller is less likely to accumulate in the axial direction.

(F) The wheel may include a plurality of tie-bar cut sections, and angles each formed by two tie-bar cut sections adjacent to each other in the circumferential direction of the roller may be all larger than the tooth pitch Pt of the wheel.

According to the configuration, since the tie-bar cut sections are not distributed unevenly in the circumferential direction of the roller, a variation in transporting resistance due to presence/absence of the tie-bar cut sections is able to be distributed in the circumferential direction. That is, since the tie-bar cut sections having no function of the teeth for transporting the medium are distributed in the circumferential direction of the roller, a variation in transporting resistance is able to be distributed in the circumferential direction.

(G) The holders may include n holding sections that individually hold the n wheels, a thickness of the holding sections in the axial direction when the wheels are stacked may be larger than a thickness of the wheels in the axial direction.

According to the configuration, since a gap between respective wheels of the n wheels that are stacked is able to be defined by the thickness of the holding sections, the roller has good ease of assembly.

(H) A medium-transporting device includes the roller described above; a second roller that holds the medium against the roller; and a drive source that rotates the roller, in which the second roller extends toward one side in the axial direction further than one of the n holding sections, which is positioned furthest on the one side in the axial direction and on the one side of which a wheel is not arranged.

According to the configuration, the thickness of the holders is able to be reduced accordingly. Even when the wheel is positionally shifted in the axial direction, the roller readily holds the medium against the second roller.

(I) A liquid ejecting apparatus includes: a liquid ejecting head that ejects a liquid; and the roller described above, in which the roller transports the medium onto which the liquid is ejected by the liquid ejecting head.

According to the configuration, since the roller transports the medium by using the teeth of the wheel, the liquid is less likely to be transferred onto the wheel even when the liquid is ejected onto the medium. For example, the liquid is less likely to be transferred onto the wheel compared with an instance in which a roller in which the wheel has no tooth and which transports the medium by coming into surface contact with the medium is used.

(J) A method of manufacturing a roller includes: a preparing step of preparing n wheels, each of which is made of metal and formed to be integrated with a holder made of synthetic resin by outsert molding, n being a natural number of 2 or more; and a stacking step of stacking the n wheels while shifting phases in the circumferential direction, in which the n wheels are stacked in the stacking step so as to satisfy the condition 1 and the condition 2. A roller exerting a similar effect to that of the roller described above is able to be easily manufactured by the manufacturing method.

What is claimed is:

1. A roller that transports a medium, the roller comprising:

a wheel having a plurality of teeth on a peripheral surface; and holders that hold n wheels, which satisfy condition 1 and condition 2, such that the n wheels are stacked in an axial direction, n being a natural number of 2 or more, condition 1: $Pr=Pt/n$, wherein Pr is a tooth pitch of the roller, and Pt is a tooth pitch of the wheel, and condition 2: a minimum value of sums of angles each formed by a reference tooth and another reference tooth adjacent to the reference tooth in a circumferential direction of one to n wheels is greater than 180 degrees, wherein one of the plurality of teeth is a reference tooth, and one of the n wheels is a reference wheel, a wheel having a reference tooth nearest to the reference tooth of the reference wheel in the circumferential direction when viewed in a rotational axis direction of the wheel is a second wheel, and wheels having reference teeth near to the reference tooth of the reference wheel in a direction identical to a direction in which the reference tooth of the second wheel is positioned with respect to the reference tooth of the reference wheel are second to nth wheels sequentially.

2. The roller according to claim 1, wherein a distance between two teeth adjacent to each other in the circumferential direction of the wheel is shorter than a distance between two wheels adjacent to each other in the axial direction.

3. The roller according to claim 1, wherein a distance between two teeth adjacent to each other in the circumferential direction of a wheel is shorter than a distance between two closest teeth of two wheels adjacent to each other in the axial direction.

4. The roller according to claim 1, wherein an angle formed by two reference teeth adjacent to each other in the circumferential direction is identical across the n wheels, and Tc*n, which is a sum of shift amounts Tc, is larger than 360°, a shift amount Tc being the angle.

5. The roller according to claim 1, wherein $N*Pt \geq 360/n$, wherein N and n are coprime with respect to each other.

6. The roller according to claim 1, wherein the wheel includes a plurality of tie-bar cut sections, and angles each formed by two tie-bar cut sections adjacent to each other in the circumferential direction of the roller are all larger than the tooth pitch Pt of the wheel.

7. The roller according to claim 1, wherein the holders include n holding sections that individually hold the n wheels, a thickness of the holding sections in the axial direction when the wheels are stacked is larger than a thickness of the wheels in the axial direction.

8. A medium-transporting device comprising:

the roller according to claim 7;

a second roller that holds the medium against the roller; and a drive source that rotates the roller, wherein the second roller extends toward one side in the axial direction further than one of the n holding sections, which is positioned furthest on the one side in the axial direction and on the one side of which a wheel is not arranged.

9. A liquid ejecting apparatus comprising:

a liquid ejecting head that ejects a liquid; and the roller according to claim 1, wherein the roller transports the medium onto which the liquid is ejected by the liquid ejecting head.

10. A method of manufacturing a roller, the method comprising:

a preparing step of preparing n wheels, each of which is made of metal and formed to be integrated with a holder made of synthetic resin by outsert molding, n being a natural number of 2 or more; and a stacking step of stacking the n wheels while shifting phases in a circumferential direction, wherein the n wheels are stacked in the stacking step so as to satisfy the condition 1 and the condition 2 according to claim 1.

* * * * *